US005451490A

United States Patent [19]

Budz et al.

[11] Patent Number: 5,451,490

[45] Date of Patent: Sep. 19, 1995

[54] DIGITAL IMAGING WITH TABULAR GRAIN EMULSIONS

[75] Inventors: Jerzy A. Budz, Fairport; Julie K. Ligtenberg; Michael R. Roberts, both of Rochester; Susan K. Mroczek, Webster, all of N.Y.

[73] Assignee: Eastman Kodak Company, Rochester, N.Y.

[21] Appl. No.: 179,056

[22] Filed: Jan. 7, 1994

Related U.S. Application Data

[63] Continuation-in-part of Ser. No. 34,050, Mar. 22, 1993, abandoned.

[51] Int. Cl.[6] ..... G03C 7/00

[52] U.S. Cl. ..... 430/363; 430/945; 430/567; 430/494; 430/944; 430/383; 430/394

[58] Field of Search ..... 430/363, 945, 567, 494, 430/944, 383, 394

[56] References Cited

U.S. PATENT DOCUMENTS

| | | | |
|---|---|---|---|
| 4,063,951 | 12/1977 | Bogg | 96/94 R |
| 4,076,529 | 2/1978 | Fleckenstein et al. | 430/223 |
| 4,386,156 | 5/1983 | Mignot | 430/567 |
| 4,399,215 | 8/1983 | Wey | 430/567 |
| 4,400,463 | 8/1983 | Maskasky | 430/434 |
| 4,414,306 | 11/1983 | Wey et al. | 430/434 |
| 4,713,323 | 12/1987 | Maskasky | 430/569 |
| 4,775,613 | 10/1988 | Hirai et al. | 430/505 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |
| 5,126,235 | 6/1992 | Hioki | 430/505 |
| 5,264,337 | 11/1993 | Maskasky | 430/567 |
| 5,275,930 | 1/1994 | Maskasky | 430/567 |
| 5,292,632 | 3/1994 | Maskasky | 430/567 |

FOREIGN PATENT DOCUMENTS

| | | |
|---|---|---|
| 479167A1 | 4/1992 | European Pat. Off. . |
| 502508A1 | 9/1992 | European Pat. Off. . |
| 2-024643 | 1/1990 | Japan . |

OTHER PUBLICATIONS

Hunt, *The Reproduction of Colour*, Fourth Edition, pp. 306–307 (1987).

Endo and Okaji, "An Empirical Rule to Modify the Habit of Silver Chloride to form Tabular Grains in an Emulsion", *The Journal of Photographic Science*, vol. 36, pp. 182–188, 1988.

Mumaw and Haugh, "Silver Halide Precipitation Coalescence Processes", *Journal of Imaging Science*, vol. 30, No. 5, Sep./Oct. 1986, pp. 198–209.

Symposium: Torino 1963 *Photographic Science*, Edited by C. Semerano and U. Mazzucato, Focal Press, pp. 52–55.

*Primary Examiner*—Thomas R. Neville

*Attorney, Agent, or Firm*—Carl O. Thomas

[57] ABSTRACT

An electronic printing method which comprises subjecting a radiation sensitive silver halide emulsion layer of a recording element to actinic radiation of at least $10^{-4}$ ergs/cm$^2$ for up to 100 microseconds duration in a pixel-by-pixel mode is disclosed. The radiation sensitive silver halide emulsion layer contains a silver halide grain population comprising at least 50 mole percent chloride, based on silver, forming the grain population projected area. At least 50 percent of the grain population projected area is accounted for by tabular grains that are bounded by {100} major faces having adjacent edge ratios of less than 10, each having an aspect ratio of at least 2.

27 Claims, 2 Drawing Sheets

2 μm

2 μm

2 μm

DIGITAL IMAGING WITH TABULAR GRAIN EMULSIONS

This is a continuation-in-part of Budz et al U.S. Ser. No. 08/034,050, filed Mar. 22, 1993, now abandoned.

FIELD OF THE INVENTION

The invention relates to a method of electronic printing wherein information is recorded in a pixel-by-pixel mode in a radiation sensitive silver halide emulsion layer.

BACKGROUND

Many known imaging systems require that a hard copy be provided from an image which is in digital form. A typical example of such a system is electronic printing of photographic images which involves control of individual pixel exposure. Such a system provides greater flexibility and the opportunity for improved print quality in comparison to optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration exposure in a pixel-by-pixel mode using a suitable exposure source such as a light emitting diode (LED) or laser. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, *The Reproduction of Colour*, Fourth Edition, pages 306–307, (1987).

Silver halide emulsions having high chloride contents, i.e., greater than 50 mole percent chloride based on silver, are known to be very desirable in image-forming systems due to the high solubility of silver chloride which permits short processing times and provides less environmentally polluting effluents. Unfortunately, it is very difficult to provide a high chloride silver halide emulsion having the high sensitivity desired in many image-forming processes. Furthermore, conventional emulsions having high chloride contents exhibit significant losses in sensitivity when they are subjected to high energy, short duration exposures of the type used in electronic printing methods of the type described previously herein. Such sensitivity losses are typically referred to as high intensity reciprocity failure.

It is known that certain tabular grain silver halide emulsions can offer a number of photographic advantages. Thus, during the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds and improved image sharpness in both mono- and multiemulsion layer formats, could be achieved by employing tabular grain emulsions.

An emulsion is generally understood to be a "tabular grain emulsion" when tabular grains account for at least 50 percent of the grain projected area. A grain is generally considered to be a tabular grain when the ratio of its equivalent circular diameter (ECD) to its thickness (t) is at least 2. The equivalent circular diameter of a grain is the diameter of a circle having an area equal to the projected area of the grain. The term "intermediate aspect ratio tabular grain emulsion" refers to an emulsion which has an average tabular grain aspect ratio in the range of from 5 to 8. The term "high aspect ratio tabular grain emulsion" refers to an emulsion which has an average tabular grain aspect ratio of greater than 8. The term "thin tabular grain" is generally understood to be a tabular grain having a thickness of less than 0.2 μm. The term "ultrathin tabular grain" is generally understood to be a tabular grain having a thickness of 0.06 μm or less. The term "high chloride" refers to grains that contain at least 50 mole percent chloride based on silver. In referring to grains of mixed halide content, the halides are named in order of increasing molar concentrations—e.g., silver iodochloride contains a higher molar concentration of chloride than iodide.

The overwhelming majority of known tabular grain emulsions contain tabular grains that are irregular octahedral grains. Regular octahedral grains contain eight identical crystal faces, each lying in a different {111} crystallographic plane. Tabular irregular octahedra contain two or more parallel twin planes that separate two major grain faces lying in {111} crystallographic planes. The {111} major faces of the tabular grains exhibit a threefold symmetry, appearing triangular or hexagonal. It is generally accepted that the tabular shape of the grains is the result of the twin planes producing favored edge sites for silver halide deposition, with the result that the grains grow laterally while increasing little, if any, in thickness after parallel twin plane incorporation.

While tabular grain emulsions have been advantageously employed in a wide variety of photographic and radiographic applications, the requirement of parallel twin plane formation and {111} crystal faces pose limitations both in emulsion preparation and use. These disadvantages are most in evidence in considering tabular grains containing significant chloride concentrations. It is generally recognized that silver chloride grains prefer to form regular cubic grains—that is, grains bounded by six identical {100} crystal faces. Tabular grains bounded by {111} faces in silver chloride emulsions often revert to nontabular forms unless morphologically stabilized.

While tabular grain silver bromide emulsions were known to the art long before the 1980's, Wey U.S. Pat. No. 4,399,215 produced the first tabular grain silver chloride emulsion. The tabular grains were of the twinned type, exhibiting major faces of threefold symmetry lying in {111} crystallographic planes. An ammoniacal double-jet precipitation technique was employed. The thicknesses of the tabular grains were high compared to contemporaneous silver bromide and bromoiodide tabular grain emulsions because the ammonia ripening agent thickened the tabular grains. To achieve ammonia ripening it was also necessary to precipitate the emulsions at a relatively high pH, which is known to produce elevated minimum densities (fog) in high chloride emulsions. Further, to avoid degrading the tabular grain geometries sought, both bromide and iodide ions were excluded from the tabular grains early in their formation.

Wey et al U.S. Pat. No. 4,414,306 developed a twinning process for preparing silver chlorobromide emulsions containing up to 40 mole percent chloride based on total silver. This process of preparation has not been successfully extended to high chloride emulsions. The highest average aspect ratio reported in the Examples was 11.

Maskasky U.S. Pat. No. 4,400,463 (hereinafter designated Maskasky I) developed a strategy for preparing a high chloride emulsion containing tabular grains with parallel twin planes and {111} major crystal faces with the significant advantage of tolerating significant internal inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. Tufano et al U.S. Pat. No. 4,804,621 employed di(hydroamino)azines as grain growth modifiers; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

Bogg U.S. Pat. No. 4,063,951 reported the first tabular grain emulsions in which the tabular grains had parallel {100} major crystal faces. The tabular grains of Bogg exhibited square or rectangular major faces, thus lacking the threefold symmetry of conventional tabular grain {111} major crystal faces. In the sole example Bogg employed an ammoniacal ripening process for preparing silver bromoiodide tabular grains having aspect ratios ranging from 4:1 to 1:1. The average aspect ratio of the emulsion was reported to be 2, with the highest aspect ratio grain (grain A in FIG. 3) being only 4. Bogg states that the emulsions can contain no more than 1 percent iodide and demonstrates only a 99.5% bromide 0.5% iodide emulsion. Attempts to prepare tabular grain emulsions by the procedures of Bogg have been unsuccessful.

Mignot U.S. Pat. No. 4,386,156 represents an improvement over Bogg in that the disadvantages of ammoniacal ripening were avoided in preparing a silver bromide emulsion containing tabular grains with square and rectangular major faces. Mignot specifically requires ripening in the absence of silver halide ripening agents other than bromide ion (e.g., thiocyanate, thioether or ammonia).

Endo and Okaji, "An Empirical Rule to Modify the Habit of Silver Chloride to form Tabular Grains in an Emulsion", *The Journal of Photographic Science*, Vol. 36, pp. 182–188, 1988, discloses silver chloride emulsions prepared in the presence of a thiocyanate ripening agent. Emulsion preparations by the procedures disclosed has produced emulsions containing a few tabular grains within a general grain population exhibiting mixed {111} and {100} faces.

Mumaw and Haugh, "Silver Halide Precipitation Coalescence Processes", *Journal of Imaging Science*, Vol. 30, No. 5, September/October 1986, pp. 198–299, is essentially cumulative with Endo and Okaji, with section IV-B being particularly pertinent.

Symposium: Torino 1963, *Photographic Science*, Edited by C. Semerano and U. Mazzucato, Focal Press, pp. 52–55, discloses the ripening of a cubic grain silver chloride emulsion for several hours at 77° C. During ripening tabular grains emerged and the original cubic grains were depleted by Ostwald ripening. As demonstrated by Preparation II which follows, after 3 hours of ripening tabular grains account for only a small fraction of the total grain projected area, and only a small fraction of the tabular grains were less than 0.3 μm in thickness. In further investigations going beyond the actual teachings provided, extended ripening eliminated many of the smaller cubic grains, but also degraded many of the tabular grains to thicker forms.

Japanese published patent application (Kokai) 02/024,643, laid open Jan. 26, 1990, was cited in a Patent Cooperation Treaty search report available to Applicants, as being pertinent to the tabular grain structures defined in the claims. In Applicants' view this application is unrelated; being directed to a negative working emulsion containing a hydrazide derivative and tabular grains with an equivalent circular diameter of 0.6 to 0.2 μm. Only conventional tabular grain preparations are disclosed and only silver bromide and bromoiodide emulsions are exemplified.

In light of the previous discussion, it is evident that the problem of this invention is to provide an electronic printing method in which a recording element containing a high chloride silver halide emulsion is subjected to short duration, high energy exposure in a pixel-by-pixel mode that is not subject to the disadvantages discussed hereinbefore. The electronic printing method of this invention, as described and claimed hereinafter, provides a solution to this problem.

RELATED COMMONLY ASSIGNED FILINGS

Maskasky U.S. Ser. No. 08/035,349, now allowed, filed Mar. 22, 1993, as a continuation-in-part of U.S. Ser. No. 955,010, filed Oct. 1, 1992, now forfeited, which is in turn a continuation-in-part of U.S. Ser. No. 764,868, filed Sep. 24, 1991, now forfeited, titled HIGH TABULARITY HIGH CHLORIDE EMULSIONS WITH INHERENTLY STABLE GRAIN FACES, commonly assigned, now U.S. Pat. No. 5,292,632, hereinafter referred to as Maskasky III, discloses high aspect ratio tabular grain high chloride emulsions containing tabular grains that are internally free of iodide and that have {100} major faces. In a preferred form, Maskasky III employs an organic compound containing a nitrogen atom with a resonance stabilized p electron pair to favor formation of {100} faces.

House, Brust, Hartsell, Black, Antoniades, Budz, Chang, Lok, Puckett and Tsaur U.S. Ser. No. 08/112,489, now U.S. Pat. No. 5,320,938, filed Aug. 25, 1993, as a continuation-in-part of U.S. Ser. Nos. 08/035,009, 08/033,738, 08/033,739, 08/034,982 and 08/034,317, each filed Mar. 22, 1993 and each now abandoned and as a continuation-in-part of now abandoned U.S. Ser. No. 08/34,060, filed Mar. 22, 1993, as a continuation-in-part of U.S. Ser. No. 940,404, filed Sep. 3, 1992 and now forfeited, which is in turn a continuation-in-part of U.S. Ser. No. 826,338, filed Jan. 27, 1992 and now forfeited, each commonly assigned, titled HIGH CHLORIDE TABULAR GRAIN EMULSIONS AND PROCESSES FOR THEIR PREPARATION, discloses emulsions containing tabular grains bounded by {100} major faces accounting for 50 percent of total grain projected area selected on the criteria of adjacent major face edge ratios of less than 10 each having an aspect ratio of at least 2 and internally at their nucleation site contain iodide and at least 50 mole percent chloride.

Szajewski U.S. Ser. No. 08/034,061, filed Mar. 22, 1993, commonly assigned and now U.S. Pat. No. 5,310,635, titled FILM AND CAMERA, discloses roll films and roll film containing cameras containing at least one emulsion layer containing tabular grain emulsions comprised of a dispersing medium and silver halide grains containing at least 50 mole percent chloride based on silver. At least 50 percent of total grain projected area is accounted for by tabular grains bounded by {100} major faces having adjacent edge ratios of less than 10, each having an aspect ratio of at least 2.

Szajewski, House, Brust, Hartsell, Black, Bohan and Merrill U.S. Ser. No. 08/069,236, filed Jun. 1, 1993, as a continuation-in-part of U.S. Ser. No. 940,404, filed Sep. 3, 1992, now forfeited, which is in turn a continuation-in-part of U.S. Ser. No. 826,338, filed Jan. 27, 1992, now forfeited, each commonly assigned, titled DYE IMAGE FORMING PHOTOGRAPHIC ELEMENTS, now allowed, discloses dye image forming photographic elements containing at least one tabular grain emulsion comprised of a dispersing medium and silver halide grains. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Maskasky U.S. Pat. No. 5,264,337, filed Mar. 22, 1993 and commonly assigned, discloses an emulsion containing a grain population internally free of iodide at the grain nucleation site and comprised of at least 50 mole percent chloride. At least 50 percent of the grain population projected area is accounted for by {100} tabular grains each having an aspect ratio of at least 2 and together having an average aspect ratio of up to 7.5.

Buchanan and Szajewski U.S. Ser. No. 08/035,347, filed Mar. 22, 1993, commonly assigned, titled METHOD OF PROCESSING PHOTOGRAPHIC ELEMENTS CONTAINING TABULAR GRAIN EMULSIONS, discloses a process of developing and desilvering a dye image forming photographic element containing a high chloride {100} tabular grain emulsion of the type herein disclosed.

SUMMARY OF THE INVENTION

In accordance with this invention, it has been found that certain novel tabular grain silver halide emulsions containing tabular grains having high chloride content and bounded by {100} major faces which meet specific criteria described in greater detail hereinafter, exhibit excellent sensitivity when they are used in the electronic printing methods discussed previously.

In one aspect the invention is directed to an electronic printing method which comprises subjecting a radiation sensitive silver halide emulsion layer of a recording element to actinic radiation of at least $10^{-4}$ ergs/cm$^2$ for up to 100 microseconds duration in a pixel-by-pixel mode. The method is characterized in that the silver halide emulsion layer contains a silver halide grain population comprising at least 50 mole percent chloride, based on silver forming the grain population projected area, wherein at least 50 percent of the grain population projected area is accounted for by tabular grains (a) bounded by {100} major faces having adjacent edge ratios of less than 10, and (b) each having an aspect ratio of at least 2.

As illustrated by the following Examples, the tabular grain silver halide emulsions employed in the practice of this invention (sometimes referred to herein simply as high chloride {100} tabular grain emulsions) do not suffer the significant loss in sensitivity (high intensity reciprocity failure) which is obtained when conventional silver halide emulsions having high chloride contents are employed in the electronic printing method described herein. This characteristic of the high chloride {100} tabular grain emulsions makes them particularly attractive in electronic printing methods because it reduces the power needed from the high energy source for exposure. Furthermore, recording elements containing high chloride {100} tabular grain emulsion layers of the type described herein retain the advantages of faster and easier processability and provide less environmentally polluting effluents which is an additional significant advantage of this invention.

The present invention has been facilitated by the discovery of a novel approach to forming tabular grains, now published in European Patent Application 534 395 A1. Instead of introducing parallel twin planes in grains as they are being formed to induce tabularity and thereby produce tabular grains with {111} major faces, it has been discovered that the presence of iodide (and/or a grain shape stabilizer) in the dispersing medium during a high chloride nucleation step coupled with maintaining the chloride ion in solution within a selected pCl range results in the formation of a tabular grain emulsion in which the tabular grains are bounded by {100} crystal faces.

The above approach to forming tabular grains places within the reach of the art tabular grains bounded by {100} crystal faces with grain compositions and grain thicknesses that have not been heretofore realized. For example, one can obtain an ultrathin tabular grain emulsion in which the grains are bounded by {100} crystal faces. In a preferred form the process described herein provides intermediate and high aspect ratio tabular grain high chloride emulsions exhibiting high levels of grain stability. Unlike high chloride tabular grain emulsions in which the tabular grains have {111} major faces, such emulsions do not require a morphological stabilizer adsorbed to the major faces of the grains to maintain their tabular form. Finally, while clearly applicable to high chloride emulsions containing iodide, the process described herein also extends to silver chloride and silver bromochloride emulsions, each of which can be prepared by variant precipitation procedures that do not require the presence of iodide ion during grain nucleation.

DESCRIPTION OF PREFERRED EMBODIMENTS

Figure 1:
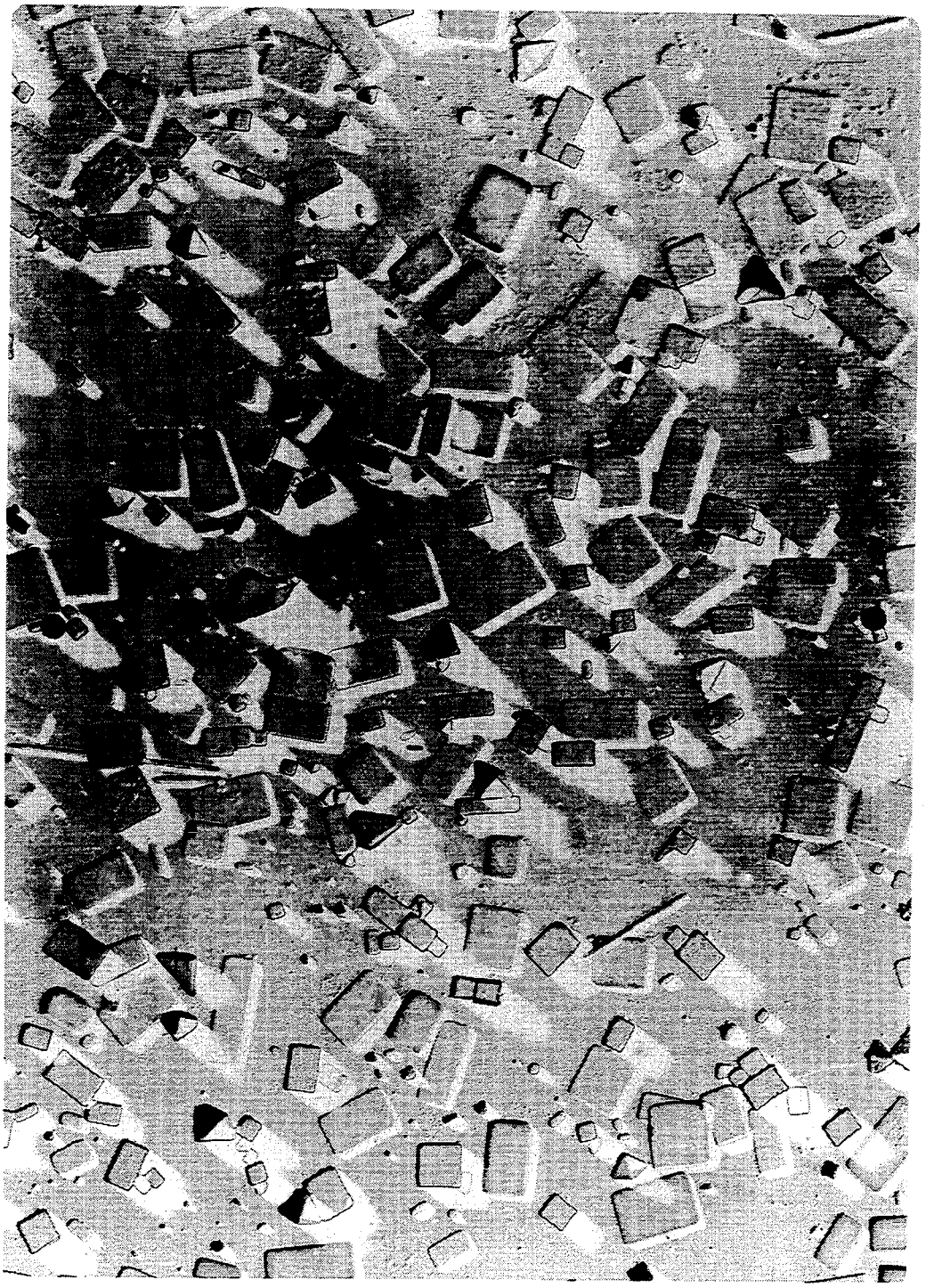
FIG. 1 is a shadowed photomicrograph of carbon grain replicas of an emulsion prepared as described in Example 1, which is a representative emulsion useful in the recording elements used in this invention.

The identification of tabular grain silver halide emulsions satisfying the requirements necessary for use in the recording elements used in this invention can be better appreciated by considering a representative tabular grain emulsion. FIG. 1 is a shadowed photomicrograph of carbon grain replicas of such an emulsion, prepared as described in Example 1 which follows. It is immediately apparent from FIG. 1 that most of the grains have orthogonal tetragonal (square or rectangular) faces. The orthogonal tetragonal shape of the grain faces indicates that they are {100} crystal faces.

The projected areas of the few grains in the sample that do not have square or rectangular faces are noted for inclusion in the calculation of the grain population projected area, but these grains clearly are not part of the tabular grain population having {100} major faces.

A few grains may be observed that are acicular or rod-like grains (hereinafter referred as rods). These grains are more than 10 times longer in one dimension than in any other dimension and can be excluded from the desired tabular grain population based on their high ratio of edge lengths. The projected area accounted for by the rods is low, but when rods are present, their projected area is noted for determining the grain population projected area.

The grains remaining all have square or rectangular major faces, indicative of {100} crystal faces. To identify the tabular grains it is necessary to determine for each grain its ratio of ECD to thickness (t)—i.e., ECD/t. ECD is determined by measuring the projected area (the product of edge lengths) of the upper surface of each grain. From the grain projected area the ECD of the grain is calculated. Grain thickness is commonly determined by oblique illumination of the grain population resulting in the individual grains casting shadows. From a knowledge of the angle of illumination (the shadow angle) it is possible to calculate the thickness of a grain from a measurement of its shadow length. The grains having square or rectangular faces and each having a ratio of ECD/t of at least 2 are tabular grains having {100} major faces. When the projected areas of the {100} tabular grains account for at least 50 percent of the grain population projected area, the emulsion is a tabular grain emulsion.

In the emulsion of FIG. 1 tabular grains account for more than 50 percent of the grain population projected area. From the preceding definition of a tabular grain, it is apparent that the average aspect ratio of the tabular grains can only approach 2, a minimum limit. In fact, tabular grain emulsions used in this invention typically exhibit average aspect ratios of 5 or more, with high average aspect ratios (greater than 8) being preferred. That is, preferred emulsions used in the invention are high aspect ratio tabular grain emulsions. In specifically preferred emulsions, average aspect ratios of the tabular grain population are at least 12 and optimally at least 20. Typically the average aspect ratio of the tabular grain population ranges up to 50, but higher aspect ratios of 100, 200 or more can be realized. Emulsions in which the average aspect ratio approaches the minimum average aspect ratio limit of 2 still provide a surface to volume ratio that is 200 percent that of cubic grains.

The tabular grain population can exhibit any grain thickness that is compatible with the average aspect ratios noted hereinbefore. However, particularly when the selected tabular grain population exhibits a high average aspect ratio, it is preferred to additionally limit the grains included in the selected tabular grain population to those that exhibit a thickness of less than 0.3 μm and, optimally, less than 0.2 μm. It is appreciated that the aspect ratio of a tabular grain can be limited either by limiting its equivalent circular diameter or increasing its thickness. Thus, when the average aspect ratio of the tabular grain population is in the range of from 2 to 8, the tabular grains accounting for at least 50 percent of the grain population projected area can also each exhibit a grain thickness of less than 0.3 μm or less than 0.2 μm. Nevertheless, in the aspect ratio range of from 2 to 8 particularly, there are specific benefits that can be gained by greater tabular grain thicknesses. For example, in constructing a blue recording emulsion layer of maximum achievable speed it is specifically contemplated that tabular grain thicknesses that are on average 1 μm or even larger can be tolerated.

The tabular grain population preferably exhibits major face edge length ratios of less than 5 and optimally less than 2. The nearer the major face edge length ratios approach 1 (i.e., equal edge lengths) the lower is the probability of a significant rod population being present in the emulsion. Further, it is believed that tabular grains with lower edge ratios are less susceptible to pressure desensitization.

In one specifically preferred form of the invention the tabular grain population accounting for at least 50 percent of the grain population projected area is provided by tabular grains also exhibiting 0.2 μm. In other words, the emulsions are in this instance thin tabular grain emulsions.

Surprisingly, ultrathin tabular grain emulsions have been prepared which satisfy the requirements needed in the recording elements used in the invention. Ultrathin tabular grain emulsions are those in which the selected tabular grain population is made up of tabular grains having an average thickness of less than 0.06 μm. Prior to the present preparation technique the only ultrathin tabular grain emulsions of a halide content exhibiting a cubic crystal lattice structure known in the art contained tabular grains bounded by {111} major faces. In other words, it was thought essential to form tabular grains by the mechanism of parallel twin plane incorporation to achieve ultrathin dimensions. Emulsions prepared as described herein can be prepared in which the tabular grain population has a mean thickness down to 0.02 μm and even 0.01 μm. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, ultrathin tabular grain emulsions described herein can have entirely negligible levels of blue sensitivity, and are therefore capable of providing a green or red record in a photographic product that exhibits minimal blue contamination even when located to receive blue light.

The characteristic of tabular grain emulsions that sets them apart from other emulsions is the ratio of grain ECD to thickness (t). This relationship has been expressed quantitatively in terms of aspect ratio. Another quantification that is believed to assess more accurately the importance of tabular grain thickness is tabularity:

$$T=ECD/t^2=AR/t$$

where

T is tabularity;

AR is aspect ratio;

ECD is equivalent circular diameter in micrometers (μm); and t is grain thickness in μm.

The high chloride tabular grain population accounting for 50 percent of the grain population projected area preferably exhibits a tabularity of greater than 25 and most preferably greater than 100. Since the tabular grain population can be ultrathin, it is apparent that extremely high tabularities, ranging to 1000 and above are within the contemplation of our invention.

The tabular grain population can exhibit an average ECD of any useful magnitude. For photographic utility average ECD's of less than 10 μm are contemplated, although average ECD's in most photographic applications rarely exceed 6 μm. Within ultrathin tabular grain emulsions satisfying the requirements of the invention it is possible to provide intermediate aspect ratios with ECD's of the tabular grain population of 0.10 μm and less. As is generally understood by those skilled in the art, emulsions with selected tabular grain populations having higher ECD's are advantageous for achieving relatively high levels of photographic sensitivity while selected tabular grain populations with lower ECD's are advantageous in achieving low levels of granularity.

So long as the population of tabular grains satisfying the parameters noted herein accounts for at least 50 percent of the grain population projected area a desirable grain population is available. It is recognized that the advantageous properties of the emulsions used in the invention are increased as the proportion of tabular grains having {100} major faces is increased. The preferred emulsions are those in which at least 70 percent and optimally at least 90 percent of total grain projected area is accounted for by tabular grains having {100} major faces. It is specifically contemplated to provide emulsions satisfying the grain descriptions described herein in which the selection of the rank ordered tabular grains extends to sufficient tabular grains to account for 70 percent or even 90 percent of total grain projected area.

So long as tabular grains having the desired characteristics described herein account for the requisite proportion of the grain population projected area, the remainder of the grain population projected area can be accounted for by any combination of coprecipitated grains. It is, of course, common practice in the art to blend emulsions to achieve specific photographic objectives. Blended emulsions in which at least one component emulsion satisfies the required tabular grain descriptions are specifically contemplated.

If tabular grains satisfying the tabular grain population requirements do not account for 50 percent of the grain population projected area, the emulsion does not satisfy the requirements for use in the invention and is, in general, a photographically inferior emulsion. For most applications (particularly applications that require spectral sensitization, require rapid processing and/or seek to minimize silver coverages) emulsions are photographically inferior in which many or all of the tabular grains are relatively thick—e.g., emulsions containing high proportions of tabular grains with thicknesses in excess of 0.3 μm.

Figure 2:
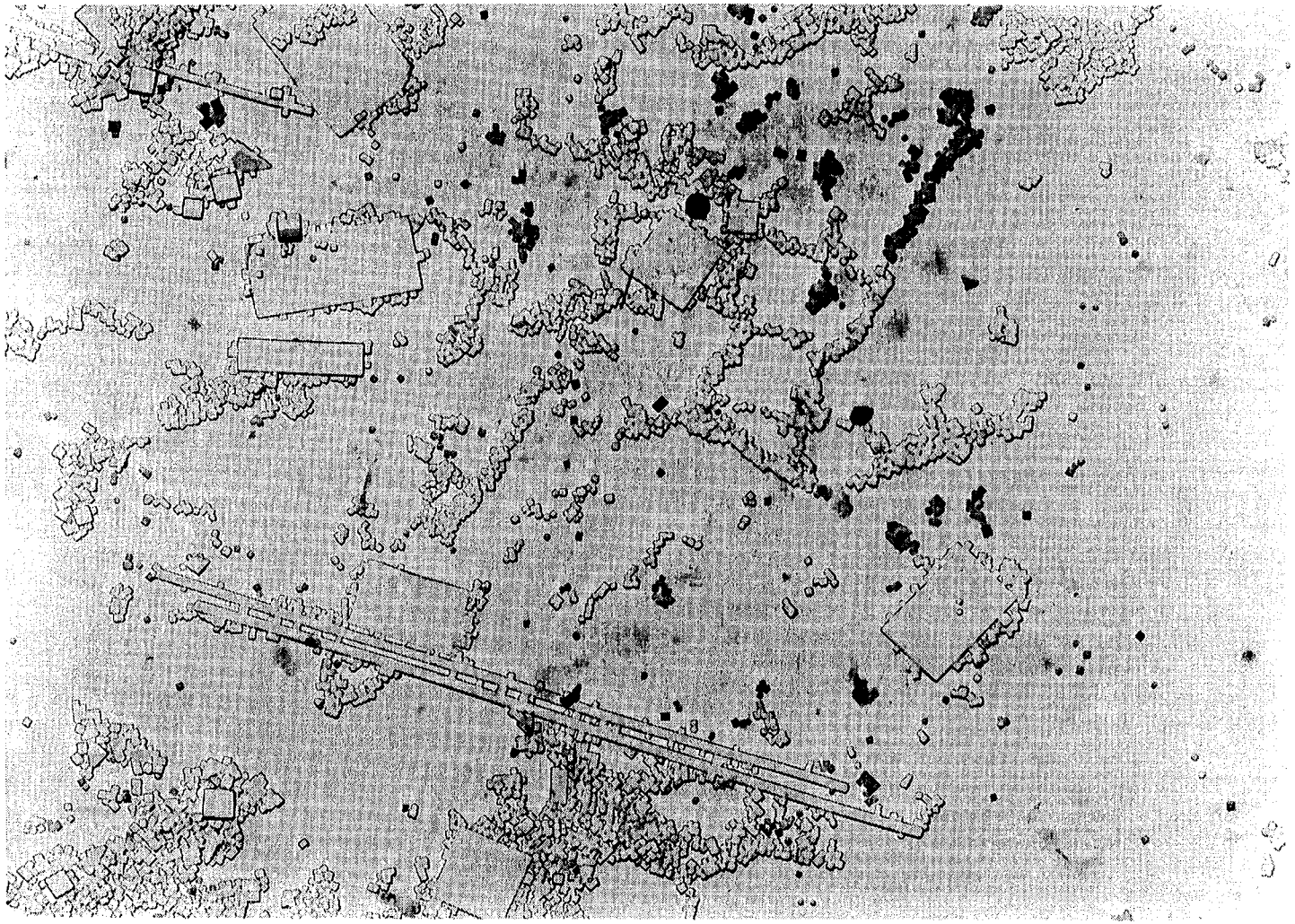
FIG. 2 is a shadowed photomicrograph of carbon grain replicas of a control emulsion prepared as described in Example 1.

More commonly, inferior emulsions failing to satisfy the requirements for the invention have an excessive proportion of the grain population projected area accounted for by cubes, twinned nontabular grains, and rods. Such an emulsion is shown in FIG. 2 (Example 1 control emulsion). Most of the grain projected area is accounted for by cubic grains. Also the rod population is much more pronounced than in FIG. 1. A few tabular grains are present, but they account for only a minor portion of the grain population projected area.

The tabular grain emulsion of FIG. 1 satisfying the requirements for the invention and the predominantly cubic grain emulsion of FIG. 2 were prepared under conditions that were identical, except for iodide management during nucleation. The FIG. 2 emulsion is a silver chloride emulsion while the emulsion of FIG. 1 additionally includes a small amount of iodide.

Obtaining emulsions satisfying the requirements for the invention has been achieved by the discovery of a novel precipitation process. In this process grain nucleation occurs in a high chloride environment in the presence of iodide ion under conditions that favor the emergence of {100} crystal faces. As grain formation occurs the inclusion of iodide into the cubic crystal lattice being formed by silver ions and the remaining halide ions is disruptive because of the much larger diameter of iodide ion as compared to chloride ion. The incorporated iodide ions introduce crystal irregularities that in the course of further grain growth result in tabular grains rather than regular (cubic) grains.

It is believed that at the outset of nucleation the incorporation of iodide ion into the crystal structure results in cubic grain nuclei being formed having one or more growth accelerating irregularities in one or more of the cubic crystal faces. The cubic crystal faces that contain at least one irregularity thereafter accept silver halide at an accelerated rate as compared to the regular cubic crystal faces (i.e., those lacking an irregularity). When only one of the cubic crystal faces contains an irregularity, grain growth on only one face is accelerated, and the resulting grain structure on continued growth is a rod. The same result occurs when only two opposite parallel faces of the cubic crystal structure contain irregularities. However, when any two contiguous cubic crystal faces contain an irregularity, continued growth accelerates growth on both faces and produces a tabular grain structure. It is believed that the tabular grains of the emulsions are produced by those grain nuclei having two, three or four faces containing growth accelerating irregularities.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride—i.e., at least half by number of the halide ions in the dispersing medium are chloride ions. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is preferably introduced into the dispersing medium concurrently with or, optimally, before opening the silver jet. Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", *J. of Photog. Science*, Vol. 10 (1962), pp. 129–134, to be 13 mole percent. In silver halide grains in which equal molar proportions of chloride and bromide ion are present up to 27 mole percent iodide, based on silver, can be incorporated in the grains. It is preferred to undertake grain nucleation and growth below the iodide saturation limit to avoid the precipitation of a separate silver iodide phase and thereby avoid creating an additional category of unwanted grains. It is generally preferred to maintain the iodide ion concentration in the dispersing medium at the outset of nucleation at less than 10 mole percent. In fact, only minute amounts of iodide at nucleation are required to achieve the desired tabular grain population. Initial iodide ion concentrations of down to 0.001 mole percent are contemplated. However, for convenience in replication of results, it is preferred to maintain initial iodide concentrations of at least 0.01 mole percent and, optimally, at least 0.05 mole percent.

In a preferred method, silver iodochloride grain nuclei are formed during the nucleation step. Minor amounts of bromide ion can be present in the dispersing medium during nucleation. Any amount of bromide ion can be present in the dispersing medium during nucleation that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. For manipulative convenience and reproducibility, silver ion introduction during the nucleation step is preferably extended for a convenient period, typically from 5 seconds to less than a minute. So long as the pCl remains within the ranges set forth above no additional chloride ion need be added to the dispersing medium during the nucleation step. It is, however, preferred to introduce both silver and halide salts concurrently during the nucleation step. The advantage of adding halide salts concurrently with silver salt throughout the nucleation step is that this permits assurance that any grain nuclei formed after the outset of silver ion addition are of essentially similar halide content as those grain nuclei initially formed. Iodide ion addition during the nucleation step is particularly preferred. Since the deposition rate of iodide ion far exceeds that of the other halides, iodide will be depleted from the dispersing medium unless replenished.

Any convenient conventional source of silver and halide ions can be employed during the nucleation step. Silver ion is preferably introduced as an aqueous silver salt solution, such as a silver nitrate solution. Halide ion is preferably introduced as alkali or alkaline earth halide, such as lithium, sodium and/or potassium chloride, bromide and/or iodide.

It is possible, but not preferred, to introduce silver chloride or silver iodochloride Lippmann grains into the dispersing medium during the nucleation step. In this instance grain nucleation has already occurred and what is referred to hereinbefore as the nucleation step is in reality a step for introduction of grain facet irregularities. The disadvantage of delaying the introduction of grain facet irregularities is that this produces thicker tabular grains than would otherwise be obtained.

The dispersing medium contained in the reaction vessel prior to the nucleation step is comprised of water, the dissolved halide ions discussed above and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., $<7.0$). To minimize fog a preferred pH range for precipitation is from 2.0 to 5.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire P010 7DD, England. While synthetic polymeric peptizers of the type disclosed by Maskasky I, cited above and here incorporated by reference, can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer. These peptizers and their preparation are described by Maskasky II and King et al, cited previously, the disclosures of which are here incorporated by reference. However, it should be noted that the grain growth modifiers of the type taught for inclusion in the emulsions of Maskasky I and II (e.g., adenine) are not appropriate for inclusion in the dispersing media, since these grain growth modifiers promote twinning and the formation of tabular grains having {111} major faces. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation. To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

The nucleation step can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

Since grain nuclei formation occurs almost instantaneously, only a very small proportion of the total silver need be introduced into the reaction vessel during the nucleation step. Typically from about 0.1 to 10 mole percent of total silver is introduced during the nucleation step.

A grain growth step follows the nucleation step in which the grain nuclei are grown until tabular grains having {100} major faces of a desired average ECD are obtained. Whereas the objective of the nucleation step is to form a grain population having the desired incorporated crystal structure irregularities, the objective of the growth step is to deposit additional silver halide onto (grow) the existing grain population while avoiding or minimizing the formation of additional grains. If additional grains are formed during the growth step, the polydispersity of the emulsion is increased and, unless conditions in the reaction vessel are maintained as described above for the nucleation step, the additional grain population formed in the growth step will not have the desired tabular grain properties described herein for use in the invention.

In its simplest form the process of preparing emulsions can be performed as a single jet precipitation without interrupting silver ion introduction from start to finish. As is generally recognized by those skilled in the art a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, single jet precipitation limits halide content and profiles and generally results in more polydisperse grain populations.

It is usually preferred to prepare photographic emulsions with the most geometrically uniform grain populations attainable, since this allows a higher percentage of the grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

In the preparation of the desired emulsions it is preferred to interrupt silver and halide salt introductions at the conclusion of the nucleation step and before proceeding to the growth step that brings the emulsions to their desired final size and shape. The emulsions are held within the temperature ranges described herein for nucleation for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of the grain population projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected accounted by the {100} tabular grains.

Once the desired population of grain nuclei have been formed, grain growth can proceed according to any convenient conventional precipitation technique for the precipitation of silver halide grains bounded by {100} grain faces. Whereas iodide and chloride ions are required to be incorporated into the grains during nucleation and are therefore present in the completed grains at the internal nucleation site, any halide or combination of halides known to form a cubic crystal lattice structure can be employed during the growth step. Neither iodide nor chloride ions need be incorporated in the grains during the growth step, since the irregular grain nuclei faces that result in tabular grain growth, once introduced, persist during subsequent grain growth independently of the halide being precipitated, provided the halide or halide combination is one that forms a cubic crystal lattice. This excludes only iodide levels above 13 mole percent (preferably 6 mole percent) in precipitating silver iodochloride, levels of iodide above 40 mole percent (preferably 30 mole percent) in precipitating silver iodobromide, and proportionally intermediate levels of iodide in precipitating silver iodohalides containing bromide and chloride. When silver bromide or silver iodobromide is being deposited during the growth step, it is preferred to maintain a pBr within the dispersing medium in the range of from 1.0 to 4.2, preferably 1.6 to 3.4. When silver chloride, silver iodochloride, silver bromochloride or silver iodobromochloride is being deposited during the growth step, it is preferred to maintain the pCl within the dispersing medium within the ranges noted above in describing the nucleation step.

It has been discovered quite unexpectedly that up to 20 percent reductions in tabular grain thicknesses can be realized by specific halide introductions during grain growth. Surprisingly, it has been observed that bromide additions during the growth step in the range of from 0.05 to 15 mole percent, preferably from 1 to 10 mole percent , based on silver, produce relatively thinner {100} tabular grains than can be realized under the same conditions of precipitation in the absence of bromide ion. Similarly, it has been observed that iodide additions during the growth step in the range of from 0.001 to <1 mole percent, based on silver, produce relatively thinner {100} tabular grains than can be realized under the same conditions of precipitation in the absence of iodide ion.

During the growth step both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445 and Wey "Growth Mechanism of AgBr Crystals in Gelatin Solution", *Photographic Science and Engineering*, Vol. 21, No. 1, January/February 1977, p. 14, et seq.

In the simplest form of the grain preparation the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described herein. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326 852, 326 853, 355 535 and 70 116, Ichizo published European Patent Application 368 275, Urabe et al published European Patent Application 374 954, and Onishi et al published Japanese Patent Application (Kokai) 172,817-A (1990).

Although the process of grain nucleation has been described hereinbefore in terms of utilizing iodide to produce the crystal irregularities required for tabular grain formation, alternative nucleation procedures have been devised, as demonstrated in the following Examples, that eliminate any requirement of iodide ion being present during nucleation in order to produce tabular grains. These alternative procedures are, further, compatible with the use of iodide during nucleation. Thus, these procedures can be relied upon entirely during nucleation for tabular grain formation or can be relied upon in combination with iodide ion during nucleation to produce tabular grains.

It has been observed that rapid grain nucleations, including so-called dump nucleations, in which significant levels of dispersing medium supersaturated with halide and silver ions exist at nucleation, accelerate introduction of the grain irregularities responsible for tabularity. Since nucleation can be achieved essentially instantaneously, immediate departures from initial supersaturation to the preferred pCl ranges noted herein are entirely consistent with this approach.

It has also been observed that maintaining the level of peptizer in the dispersing medium during grain nucleation at a level of less than 1 percent by weight enhances tabular grain formation. It is believed that coalescence of grain nuclei pairs can be at least in part responsible for introducing the crystal irregularities that induce tabular grain formation. Limited coalescence can be promoted by withholding peptizer from the dispersing medium or by initially limiting the concentration of peptizer. Mignot U.S. Pat. No. 4,334,012 illustrates grain nucleation in the absence of a peptizer with removal of soluble salt reaction products to avoid coalescence of nuclei. Since limited coalescence of grain nuclei is considered desirable, the active interventions of Mignot to eliminate grain nuclei coalescence can be either eliminated or moderated. It is also contemplated to enhance limited grain coalescence by employing one or more peptizers that exhibit reduced adhesion to grain surfaces. For example, it is generally recognized that low methionine gelatin of the type disclosed by Maskasky II is less tightly absorbed to grain surfaces than gelatin containing higher levels of methionine. Further moderated levels of grain adsorption can be achieved with so-called "synthetic peptizers"—that is, peptizers formed from synthetic polymers. The maximum quantity of peptizer compatible with limited coalescence of grain nuclei is, of course, related to the strength of adsorption to the grain surfaces. Once grain nucleation has been completed, immediately after silver salt introduction, peptizer levels can be increased to any convenient conventional level for the remainder of the precipitation process.

The emulsions used in the recording elements include silver chloride emulsions, silver iodochloride emulsions, silver iodo-bromochloride emulsions and silver iodochlorobromide emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium, rhenium, and Group VIII metals (e.g., iron, ruthenium, rhodium, palladium, osmium, iridium and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

Dopants and their addition are illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; McBride U.S. Pat. No. 3,287,136; Sidebotham U.S. Pat. No. 3,488,709; Rosecrants et al U.S. Pat. No. 3,737,313; Spence et al U.S. Pat. No. 3,687,676; Gilman et al U.S. Pat. No. 3,761,267; Shiba et al U.S. Pat. No. 3,790,390; Ohkubo et al U.S. Pat. No. 3,890,154; Iwaosa et al U.S. Pat. No. 3,901,711; Habu et al U.S. Pat. No. 4,173,483; Atwell U.S. Pat. No. 4,269,927; Janusonis et al U.S. Pat. No. 4,835,093; McDugle et al U.S Pat. Nos. 4,933,272, 4,981,781, and 5,037,732; Keevert et al U.S. Pat. No. 4,945,035; and Evans et al U.S. Pat. No. 5,024,931, the disclosures of which are here incorporated by reference. For background as to alternatives known to the art attention is directed to B. H. Carroll, "Iridium Sensitization: A Literature Review", *Photographic Science and Engineering*, Vol. 24, NO. 6, November/December 1980, pp. 265–257, and Grzeskowiak et al published European Patent Application 264 288.

The novel precipitation process is particularly advantageous in providing high chloride (greater than 50 mole percent chloride) tabular grain emulsions, since conventional high chloride tabular grain emulsions having tabular grains bounded by {111} are inherently unstable and require the presence of a morphological stabilizer to prevent the grains from regressing to non-tabular forms. Particularly preferred high chloride emulsions are those that contain more than 70 mole percent (optimally more than 90 mole percent) chloride.

Although not essential, a further procedure that can be employed to maximize the population of tabular grains having {100} major faces is to incorporate an agent capable of restraining the emergence of non-{100} grain crystal faces in the emulsion during its preparation. The restraining agent, when employed, can be active during grain nucleation, during grain growth or throughout precipitation.

Useful restraining agents under the contemplated conditions of precipitation are organic compounds containing a nitrogen atom with a resonance stabilized p electron pair. Resonance stabilization prevents protonation of the nitrogen atom under the relatively acid conditions of precipitation.

Aromatic resonance can be relied upon for stabilization of the $\pi$ electron pair of the nitrogen atom. The nitrogen atom can either be incorporated in an aromatic ring, such as an azole or azine ring, or the nitrogen atom can be a ring substituent of an aromatic ring.

In one preferred form the restraining agent can satisfy the following formula:

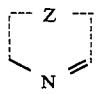

where

Z represents the atoms necessary to complete a five or six membered aromatic ring structure, preferably formed by carbon and nitrogen ring atoms. Preferred aromatic rings are those that contain one, two or three nitrogen atoms. Specifically contemplated ring structures include 2H-pyrrole, pyrrole, imidazole, pyrazole, 1,2,3-triazole, 1,2,4-triazole, 1,3,5-triazole, pyridine, pyrazine, pyrimidine, and pyridazine.

When the stabilized nitrogen atom is a ring substituent, preferred compounds satisfy the following formula:

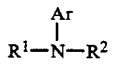

(II)

where

Ar is an aromatic ring structure containing from 5 to 14 carbon atoms and $R^1$ and $R^2$ are independently hydrogen, Ar, or any convenient aliphatic group or together complete a five or six membered ring.

Ar is preferably a carbocyclic aromatic ring, such as phenyl or naphthyl. Alternatively any of the nitrogen and carbon containing aromatic rings noted above can be attached to the nitrogen atom of formula II through a ring carbon atom. In this instance, the resulting compound satisfies both formulae I and II. Any of a wide variety of aliphatic groups can be selected. The simplest contemplated aliphatic groups are alkyl groups, preferably those containing from 1 to 10 carbon atoms and most preferably from 1 to 6 carbon atoms. Any functional substituent of the alkyl group known to be compatible with silver halide precipitation can be present. It is also contemplated to employ cyclic aliphatic substituents exhibiting 5 or 6 membered rings, such as cycloalkane, cycloalkene and aliphatic heterocyclic rings, such as those containing oxygen and/or nitrogen hetero atoms. Cyclopentyl, cyclohexyl, pyrrolidinyl, piperidinyl, furanyl and similar heterocyclic rings are specifically contemplated.

The following are representative of compounds contemplated satisfying formulae I and/or II:

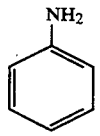

aniline

RA-1

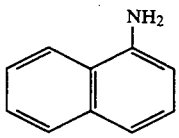

a-naphthylamine

RA-2

-continued
RA-3
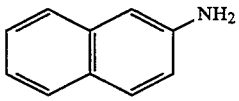
b-naphthylamine
RA-4
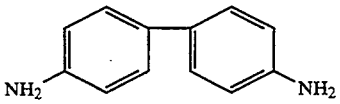
benzidine
RA-5
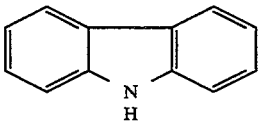
carbazole
RA-6
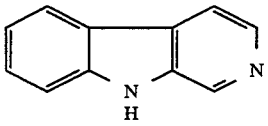
norharman
RA-7
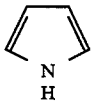
pyrrole
RA-8
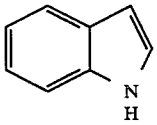
indole
RA-9
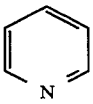
pyridine
RA-10
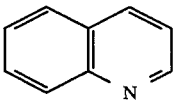
quinoline
RA-11
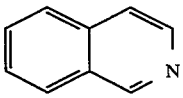
isoquinoline
RA-12
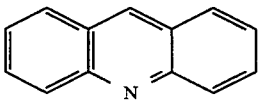
acridine
RA-13
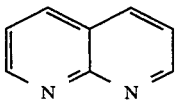
1,8-naphthyridine
-continued
RA-14
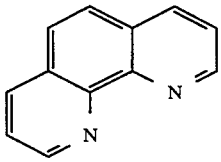
1,10-phenanthroline
RA-15
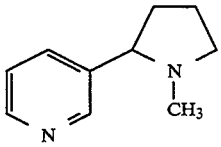
nicotine
RA-16
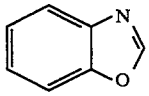
benzoxazole
RA-17
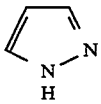
pyrazole
RA-18
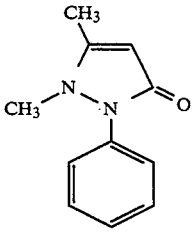
antipyrine
RA-19
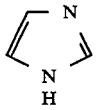
imidazole
RA-20
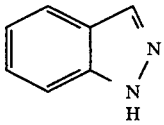
indazole
RA-21
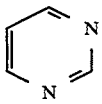
pyrimidine
RA-22
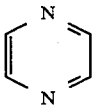
pyrazine
RA-23
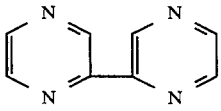
2,2'-bipyrazine -continued

RA-24

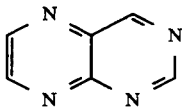

pteridine

RA-25

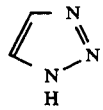

1,2,3-triazole

RA-26

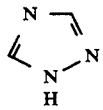

1,2,4-triazole

RA-27

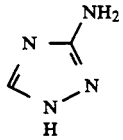

3-amino-1,2,4-triazole

RA-28

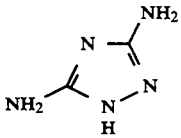

3,5-diamino-1,2,4-triazole

RA-29

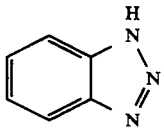

benzotriazole

RA-30

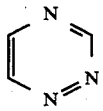

1,2,4-triazine

RA-31

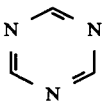

1,3,5-triazine

Selection of preferred restraining agents and their useful concentrations can be accomplished by the following selection procedure: The compound being considered for use as a restraining agent is added to a silver chloride emulsion consisting essentially of cubic grains with a mean grain edge length of 0.3 μm. The emulsion is 0.2M in sodium acetate, has a pCl of 2.1, and has a pH that is at least one unit greater than the pKa of the compound being considered. The emulsion is held at 75° C. with the restraining agent present for 24 hours. If, upon microscopic examination after 24 hours, the cubic grains have sharper edges of the {100} crystal faces than a control differing only in lacking the compound being considered, the compound introduced is performing the function of a restraining agent. The significance of sharper edges of intersection of the {100} crystal faces lies in the fact that grain edges are the most active sites on the grains in terms of ions reentering the dispersing medium. By maintaining sharp edges the restraining agent is acting to restrain the emergence of non-{100} crystal faces, such as are present, for example, at rounded edges and corners. In some instances instead of dissolved silver chloride depositing exclusively onto the edges of the cubic grains a new population of grains bounded by {100} crystal faces is formed. Optimum restraining agent activity occurs when the new grain population is a tabular grain population in which the tabular grains are bounded by {100} major crystal faces.

It is specifically contemplated to deposit epitaxially silver salt onto the tabular grains acting as hosts. Conventional epitaxial depositions onto high chloride silver halide grains are illustrated by Maskasky U.S. Pat. No. 4,435,501 (particularly Example 24B); Ogawa et al U.S. Pat. Nos. 4,786,588 and 4,791,053; Hasebe et al U.S. Pat. Nos. 4,820,624 and 4,865,962; Sugimoto and Miyake, "Mechanism of Halide Conversion Process of Colloidal AgCl Microcrystals by $Br^-$ Ions", Parts I and II, *Journal of Colloid and Interface Science*, Vol. 140, No. 2, December 1990, pp. 335–361; Houle et al U.S. Pat. No. 5,035,992; and Japanese published applications (Kokai) 252649-A (priority 02.03.90-JP 051165 Japan) and 288143-A (priority 04.04.90-JP 089380 Japan); and published European Patent Applications 273 430, 341 728, and 531 799. The disclosures of the above U.S. patents are here incorporated by reference.

The emulsions used in this invention can be chemically sensitized with active gelatin as illustrated by T. H. James, *The Theory of the Photographic Process*, 4th Ed., Macmillan, 1977, pp. 67–76, or with sulfur, selenium, tellurium, gold, platinum, palladium, iridium, osmium, rhenium or phosphorus sensitizers or combinations of these sensitizers, (particularly combinations of sulfur with gold or selenium), such as at pAg levels of from 5 to 10, pH levels of from 5 to 8 and temperatures of from 30° to 80° C., as illustrated by *Research Disclosure*, Vol. 120, April, 1974, Item 12008, *Research Disclosure*, Vol. 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415, Simons U.K. Patent 1,396,696 and Deaton U.S. Pat. No. 5,049,485, chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al published European Patent Application 294 149 and Tanaka et al published European Patent Application 297 804; and thiosulfonates as described by Nishikawa et al published European Patent Application 293 917. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure*, Vol. 136, August, 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application 302 528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan, cited above, the chemical sensitizers can be added prior to or concurrently with the additional silver halide formation. Chemical sensitization can take place during or after halide conversion as described by Hasebe et al published European Patent Application 273 404. In many instances epitaxial deposition onto selected tabular grain sites (e.g., edges or corners) can either be used to direct chemical sensitization or to itself perform the functions normally performed by chemical sensitization.

The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-di-oxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths 5 throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. An example of a material which is sensitive in the infrared spectrum is shown in Simpson et al., U.S. Pat. No. 4,619,892, which describes a material which produces cyan, magenta and yellow dyes as a function of exposure in three regions of the infrared spectrum (sometimes referred to as "false"sensitization). Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within 5 the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions described herein are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. No. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No.

3,672,898, the disclosures of which are here incorporated by reference.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application 301 508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application 287 100 and Metoki et al published European Patent Application 291 399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302 528. The spectral sensitizing dyes may be used in conjunction with poorly adsorbed luminescent dyes, as described by Miyasaka et al published European Patent Applications 270 079, 270 082 and 278 510.

The following illustrate specific spectral sensitizing dye selections:

SS-1

Anhydro-5'-chloro-3'-di-(3-sulfopropyl)naphtho[1,2-d]thiazolothiacyanine hydroxide, sodium salt

SS-2

Anhydro-5'-chloro-3'-di-(3-sulfopropyl)naphtho[1,2-d]oxazolothiacyanine hydroxide, sodium salt

SS-3

Anhydro-4,5-benzo-3'-methyl-4'-phenyl-1-(3-sulfopropyl)naphtho[1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-di-(trifluoromethyl)-3-(4-sulfobutyl)-3'-(2,2,2-trifluoroethyl)benzimidazolocarbocyanine hydroxide

SS-6

Anhydro-3,3'-(2-methoxyethyl)-5,5'-diphenyl-9-ethyloxacarbocyanine, sodium salt

SS-7

Anhydro-11-ethyl-1,1'-di-(3-sulfopropyl)naphtho[1,2-d]oxazolocarbocyanine hydroxide, sodium salt

SS-8

Anhydro-5,5'-dichloro-9-ethyl-3,3'-di-(3-sulfopropyl-)oxaselenacarbocyanine hydroxide, sodium salt

SS-9

5,6-Dichloro-3',3'-dimethyl-1,1',3-triethylbenzimidazolo-3H-indolocarbocyanine bromide

SS-10

Anhydro-5,6-dichloro-1,1-diethyl-3-(3-sulfopropylbenzimidazolooxacarbocyanine hydroxide

SS-11

Anhydro-5,5'-dichloro-9-ethyl-3,3'-di-(2-sulfoethylcarbamoylmethyl)thiacarbocyanine hydroxide, sodium salt

SS-12

Anhydro-5',6'-dimethoxy-9-ethyl-5-phenyl-3-(3-sulfobutyl)-3'-(3-sulfopropyl)oxathiacarbocyanine hydroxide, sodium salt

SS-13

Anhydro-5,5'-dichloro-9-ethyl-3-(3-phosphonopropyl)-3'-(3-sulfopropyl)thiacarbocyanine hydroxide

SS-14

Anhydro-3,3'-di-(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)-3,5-dimethyl-3'-ethyltellurathiacarbocyanine bromide

SS-17

Anhydro-5,6-methylenedioxy-9-ethyl-3-methyl-3'-(3-sulfopropyl)tellurathiacarbocyanine hydroxide

SS-18

-Ethyl-6,6'-dimethyl-3'-pentyl-9.11-neopentylenethiadicarbocyanine bromide

SS-19

Anhydro-3-ethyl-9,11-neopentylene-3'-(3-sulfopropyl)-thiadicarbocyanine hydroxide

SS-20

Anhydro-3-ethyl-11,13-neopentylene-3'-(3-sulfopropyl-)oxathiatricarbocyanine hydroxide, sodium salt

SS-21

Anhydro-5-chloro-9-ethyl-5'-phenyl-3'-(3-sulfobutyl)-3-(3-sulfopropyl)oxacarbocyanine hydroxide, sodium salt

SS-22

Anhydro-5,5'-diphenyl-3,3'-di-(3-sulfobutyl)-9-ethyloxacarbocyanine hydroxide, sodium salt

SS-23

Anhydro-5,5'-dichloro-3,3'-di-(3-sulfopropyl)-9-ethylthiacarbocyanine hydroxide, triethylammonium salt

SS-24

Anhydro-5,5'-dimethyl-3,3'-di-(3-sulfopropyl)-9-ethylthiacarbocyanine hydroxide, sodium salt

SS-25

Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt

SS-26

Anhydro-11-ethyl-1,1'-di-(3-sulfopropyl)naphth[1,2-d]oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6'-dichloro-1,1'-diethyl-3,3'-di-(3-sulfopropyl)-5,5'-bis(trifluoromethyl)benzimidazolocarbocyanine hydroxide, sodium salt

SS-29

Anhydro-5'-chloro-5-phenyl-3,3'-di-(3-sulfopropyl)oxathiacyanine hydroxide, sodium salt

SS-30

Anhydro-5,5'-dichloro-3,3'-di-(3-sulfopropyl)thiacyanine hydroxide, sodium salt

SS-31

3-Ethyl-5-[1,4-dihydro-1-(4-sulfobutyl)pyridin-4-ylidene]rhodanine, triethylammonium salt

SS-32

1-Carboxyethyl-5-[2-(3-ethylbenzoxazolin-2-ylidene)ethylidene]-3-phenylthiohydantoin

SS-33

4-[2-((1,4-Dihydro-1-dodecylpyridin-ylidene)ethylidene]-3-phenyl-2-isoxazolin-5-one

SS-34

5-(3-Ethylbenzoxazolin-2-ylidene)-3-phenylrhodanine

SS-35

1,3-Diethyl-5-{[1-ethyl-3-(3-sulfopropyl)benzimidazolin-2-ylidene]ethylidene}-2-thiobarbituric acid

SS-36

5-[2-(3-Ethylbenzoxazolin-2-ylidene)ethylidene]-1-methyl-2-dimethylamino-4-oxo-3-phenylimidazolinium p-toluenesulfonate

SS-37

5-[2-(5-Carboxy-3-methylbenzoxazolin-2-ylidene)ethylidene]-3-cyano-4-phenyl-1-(4-methylsulfonamido-3-pyrrolin-5-one

SS-38

2-[4-(Hexylsulfonamido)benzoylcyanomethine]-2-{2-{3-(2-methoxyethyl)-5-[(2-methoxyethyl)sulfonamido]benzoxazolin-2-ylidene}ethylidene}acetonitrile

SS-39

3-Methyl-4-[2-(3-ethyl-5,6-dimethylbenzotellurazolin-2-ylidene)ethylidene]-1-phenyl-2-pyrazolin-5-one

SS-40

3-Heptyl-1-phenyl-5-{4-[3-(3-sulfobutyl)-naphtho[1,2-d]thiazolin]-2-butenylidene}-2-thiohydantoin

SS-41

1,4-Phenylene-bis(2-aminovinyl-3-methyl-2-thiazolinium]dichloride

SS-42

Anhydro-4-{2-[3-(3-sulfopropyl)thiazolin-2-ylidene]ethylidene}-2-{3-[3-(3-sulfopropyl)thiazolin-2-ylidene]propenyl-5-oxazolium, hydroxide, sodium salt

SS-43

3-Carboxymethyl-5-{3-carboxymethyl-4-oxo-5-methyl1,3,4-thiadiazolin-2-ylidene)ethylidene]thiazolin-2-ylidene}rhodanine, dipotassium salt

SS-44

1,3-Diethyl-5-[1-methyl-2-(3,5-dimethylbenzotellurazolin-2-ylidene)ethylidene]-2-thiobarbituric acid

SS-45

3-Methyl-4-[2-(3-ethyl-5,6-dimethylbenzotellurazolin-2-ylidene)-1-methylethylidene]-1-phenyl-2-pyrazolin-5-one

SS-46

1,3-Diethyl-5-[1-ethyl-2-(3-ethyl-5,6-dimethoxybenzotellurazolin-2-ylidene)ethylidene]-2-thiobarbituric acid

SS-47

3-Ethyl-5-{[(ethylbenzothiazolin-2-ylidene)-methyl][(1,5-dimethylnaphtho[1,2-d]selenazolin-2-ylidene)methyl]methylene}rhodanine

SS-48

5-{Bis[(3-ethyl-5,6-dimethylbenzothiazolin-2-ylidene)-methyl]methylene)-1,3-diethyl-barbituric acid

SS-49

3-Ethyl-5-{[(3-ethyl-5-methylbenzotellurazolin-2-ylidene)methyl][1-ethylnaphtho[1,2-d]-tellurazolin-2-ylidene)methyl]methylene}rhodanine

SS-50

Anhydro-5,5'-diphenyl-3,3'-di-(3-sulfopropyl)thiacyanine hydroxide, triethylammonium salt

SS-51

Anhydro-5-chloro-5'-phenyl-3,3'-di-(3-sulfopropyl)-thiacyanine hydroxide, triethylammonium salt Additional suitable spectral sensitizing dyes are included in the Examples.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions used in this invention can also be used in developers and can be classified under a few general headings, as illustrated by C. E. K. Mees, *The Theory of the Photographic Process*, 2nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure*, Vol. 134, June, 1975, Item 13452, and Vol. 148, August, 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure*, Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure*, Item 11684, cited above; purines as illustrated by Sheppard et al U.S. Pat. No. 2,319,090, Birr et al U.S. Pat. No. 2,152,460, *Research Disclosure*, Item 13452, cited above, and Dostes et al French Patent 2,296,204, polymers of 1,3-dihydroxy-(and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High chloride emulsions can be stabilized by the presence, especially during chemical sensitization, of elemental sulfur as described by Miyoshi et al European published Patent Application 294 149 and Tanaka et al published European Patent Application 297 804 and thiosulfonates as described by Nishikawa et al published European Patent Application 293 917.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Patent 1,466,024 and Habu et al U.S. Pat. No. 3,929,486; quaternary ammonium salts of the type illustrated by Piper U.S. Pat. No. 2,886,437; water-insoluble hydroxides as illustrated by Maffet U.S. Pat. No. 2,953,455; phenols as illustrated by Smith U.S. Pat. Nos. 2,955,037 and '038; ethylene diurea as illustrated by Dersch U.S. Pat. No. 3,582,346; barbituric acid derivatives as illustrated by Wood U.S. Pat. No. 3,617,290; boranes as illustrated by Bigelow U.S. Pat. No. 3,725,078; 3-pyrazolidinones as illustrated by Wood U. K. Patent 1,158,059 and aldoximines, amides, anilides and esters as illustrated by Butler et al U.K. Patent 988,052.

The high chloride {100} tabular grain emulsions described herein can be protected from fog and desensitization caused by trace amounts of metals such as copper, lead, tin, iron and the like by incorporating addenda such as sulfocatechol-type compounds, as illustrated by Kennard et al U.S. Pat. No. 3,236,652; aldoximines as illustrated by Carroll et al U.K. Patent 623,448 and meta-and polyphosphates as illustrated by Draisbach U.S. Pat. No. 2,239,284, and carboxylic acids such as ethylenediamine tetraacetic acid as illustrated by U.K. Patent 691,715.

Among stabilizers useful in layers containing synthetic polymers of the type employed as vehicles and to improve covering power are monohydric and polyhydric phenols as illustrated by Forsgard U.S. Pat. No. 3,043,697; saccharides as illustrated by U.K. Patent 897,497 and Stevens et al U.K. Patent 1,039,471, and quinoline derivatives as illustrated by Dersch et al U.S. Pat. No. 3,446,618.

Among stabilizers useful in protecting the emulsion layers against dichroic fog are addenda such as salts of nitron as illustrated by Barbier et al U.S. Pat. Nos. 3,679,424 and 3,820,998; mercaptocarboxylic acids as illustrated by Willems et al U.S. Pat. No. 3,600,178; and addenda listed by E. J. Birr, *Stabilization of Photographic Silver Halide Emulsions*, Focal Press, London, 1974, pp. 126–218.

Among stabilizers useful in protecting emulsion layers against development fog are addenda such as azabenzimidazoles as illustrated by Bloom et al U.K. Patent 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives as illustrated by Herz et al U.S. Pat. No. 3,220,839, and thiodiazole derivatives as illustrated by yon Konig U.S. Pat. No. 3,364,028 and von Konig et al U.K. Patent 1,186,441.

Where hardeners of the aldehyde type are employed, the emulsion layers can be protected with antifoggants such as monohydric and polyhydric phenols of the type illustrated by Sheppard et al U.S. Pat. No. 2,165,421; nitro-substituted compounds of the type disclosed by Rees et al U.K. Patent 1,269,268; poly(alkylene oxides) as illustrated by Valbusa U.K. Patent 1,151,914, and mucohalogenic acids in combination with urazoles as illustrated by Allen et al U.S. Pat. Nos. 3,232,761 and 3,232,764, or further in combination with maleic acid hydrazide as illustrated by Rees et al U.S. Pat. No. 3,295,980.

To protect emulsion layers coated on linear polyester supports, addenda can be employed such as parabanic acid, hydantoin acid hydrazides and urazoles as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate as illustrated by Overman U.S. Pat. No. 2,628,167; compounds, polymeric lattices and dispersions of the type disclosed by Jones et al U.S. Pat. Nos. 2,759,821 and '822; azole and mercaptotetrazole hydrophilic colloid dispersions of the type disclosed by *Research Disclosure*, Vol. 116, December, 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric lattices prepared by emulsion polymerization in the presence of poly(alkylene oxide) as disclosed by Pearson et al U.S. Pat. No. 3,772,032, and gelatin graft copolymers of the type disclosed by Rakoczy U.S. Pat. No. 3,837,861.

Where the recording element used in this invention is to be processed at elevated bath or drying temperatures, as in rapid access processors, pressure desensitization and/or increased fog can be controlled by selected combinations of addenda, vehicles, hardeners and/or processing conditions as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure*, Vol. 99, July, 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent-image fading, latent-image stabilizers can be incorporated, such as amino acids, as illustrated by Ezekiel U.K. Patents 1,335,923, 1,378,354, 1,387,654 and 1,391,672, Ezekiel et al U.K. Patent 1,394,371, Jefferson U.S. Pat. No. 3,843,372, Jefferson et al U.K. Patent 1,412,294 and Thurston U.K. Patent 1,343,904; carbonyl-bisulfite addition products in combination with hydroxybenzene or aromatic amine developing agents as illustrated by Seiter et al U.S. Pat. No. 3,424,583; cycloalkyl-1,3-diones as illustrated by Beckett et al U.S. Pat. No. 3,447,926; enzymes of the catalase type as illustrated by Matejec et al U.S. Pat. No. 3,600,182; halogen-substituted hardeners in combination with certain cyanine dyes as illustrated by Kumai et al U.S. Pat. No. 3,881,933; hydrazides as illustrated by Honig et al U.S. Pat. No. 3,386,831; alkenyl benzothiazolium salts as illustrated by Arai et al U.S. Pat. No. 3,954,478; hydroxy-substituted benzylidene derivatives as illustrated by Thurston U.K. Patent 1,308,777 and Ezekiel et al U.K. Patents 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives as illustrated by Ezekiel U.K. Patent 1,389,089; propynylthio derivatives of benzimidazoles, pyrimidines, etc., as illustrated by von Konig et al U.S. Pat. No. 3,910,791; combinations of iridium and rhodium compounds as disclosed by Yamasue et al U.S. Pat. No. 3,901,713; sydnones or sydnone imines as illustrated by Noda et al U.S. Pat. No. 3,881,939; thiazolidine derivatives as illustrated by Ezekiel U.K. Patent 1,458,197 and thioether-substituted imidazoles as illustrated by *Research Disclosure*, Vol. 136, August, 1975, Item 13651.

In their simplest form photographic elements of the invention employ a single silver halide emulsion layer containing high chloride {100} tabular grain emulsions and a support. It is, of course, recognized that more than one such silver halide emulsion layer can be usefully included. Where more than one emulsion layer is used, e.g., two emulsion layers, all such layers can be high chloride {100} tabular grain emulsion layers. However, the use of one or more conventional silver halide emulsion layers, including other tabular grain emulsion layers, in combination with one or more high chloride {100} tabular grain emulsion layers is specifically contemplated. It is also specifically contemplated to blend the high chloride {100} tabular grain emulsions of the present invention with each other or with conventional emulsions to satisfy specific emulsion layer requirements. Instead of blending emulsions, the same effect can usually be achieved by coating the emulsions to be blended as separate layers in an emulsion unit. For example, coating of separate emulsion layers to achieve exposure latitude is well known in the art. It is further well known in the art that increased photographic speed can be realized when faster and slower silver halide emulsions are coated in separate layers. Typically the faster emulsion layer in an emulsion unit is coated to lie nearer the exposing radiation source than the slower emulsion layer. Coating the faster and slower emulsions in the reverse layer order can change the contrast obtained. This approach can be extended to three or more superimposed emulsion layers in an emulsion unit. Such layer arrangements are specifically contemplated in the practice of this invention.

The recording elements used in the methods of this invention can contain dye image-forming compounds that are in reactive association with the high chloride {100} tabular grains as well as other silver halide emulsions present. Such dye image-forming compound is typically a coupler compound, a dye redox releaser compound, a dye developer compound, an oxichromic developer compound, or a bleachable dye or dye precursor compound. Dye redox releaser, dye developer, and oxichromic developer compounds useful in color photographic elements that can be employed in image transfer processes are described in *The Theory of the Photographic Process*, 4th edition, T. H. James, editor, Macmillan, New York, 1977, Chapter 12, Section V, and in Section XXIII of *Research Disclosure*, Item 308119, cited above. Dye compounds useful in color photographic elements employed in dye bleach processes are described in Chapter 12, Section IV, of *The Theory of the Photographic Process*, 4th edition.

Suitable dye image-forming compounds are coupler compounds, which react with oxidized color developing agents to form colored products, or dyes. A coupler compound contains a coupler moiety COUP, which is combined with the oxidized developer species in the coupling reaction to form the dye structure. A coupler compound can additionally contain a group, called a coupling-off group, that is attached to the coupler moiety by a bond that is cleaved upon reaction of the coupler compound with oxidized color developing agent. Coupling-off groups can be halogen, such as chloro, bromo, fluoro, and iodo, or organic radicals that are attached to the coupler moieties by atoms such as oxygen, sulfur, nitrogen, phosphorus, and the like.

Following is a listing of patents and publications that describe representative coupler compounds that contain COUP groups useful in the invention:

Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999, "Farbkuppler-eine Literaturubersicht," published in Agfa Mitteilungen, Band III, pp. 156–175 (1961), and Section VII D of *Research Disclosure*, Item 308119, cited above. Preferably such couplers are phenols and naphthols.

Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573, "Farbkuppler-eine Literaturubersicht," published in Agfa Mitteilungen, Band III, pp. 126–156 (1961), and Section VII D of *Research Disclosure*, Item 308119, cited above. Preferably such couplers are pyrazolones or pyrazolotriazoles.

Couplers which form yellow dyes upon reaction with oxidized and color developing agent are described in such representative patents and publications as: U.S. Pat. Nos. 2,875,057; 2,407,210; 3,265,506; 2,298,443; 3,048,194; 3,447,928, "Farbkuppler-eine Literaturubersicht," published in Agfa Mitteilungen, Band III, pp. 112–126 (1961), and Section VII D of *Research Disclosure*, Item 308119, cited above. Preferably such couplers are acylacetamides, such as benzoylacetamides and pivaloylacetamides.

The dye image-forming compounds can be incorporated in recording elements used in the present invention by means and processes known in the photographic art. A recording element in which the dye image-forming compounds are incorporated can be a 0 monocolor or monochrome element comprising a support and a single silver halide emulsion layer. In such a monochrome element, the image can be formed from metallic silver, from a dye or a mixture of dyes, or from a combination of dyes and metallic silver. A 5 recording element of the invention can also be a multicolor, multilayer element comprising a support and multiple silver halide emulsion layers. The above described dye image-forming compounds can be incorporated in at least one of the silver halide emulsion layers and/or in at least one other layer, such as an adjacent layer, where they are in reactive association with the silver halide emulsion layer and are thereby able to react with the oxidized developing agent produced by development of silver halide in the emulsion layer. Additionally, the silver halide emulsion layers and other layers of the recording element can contain addenda conventionally contained in such layers.

A useful multicolor, multilayer photographic element can comprise a support having thereon a red-sensitized silver halide emulsion unit having associated therewith a cyan dye image-forming compound, a green-sensitized silver halide emulsion unit having associated therewith a magenta dye image-forming compound, and a blue-sensitized silver halide emulsion unit having associated therewith a yellow dye image-forming compound. Each silver halide emulsion unit can be composed of one or more layers, and the various units and layers can be arranged in different locations with respect to one another, as known in the prior art and as illustrated by multilayer formats hereinafter described.

In the following discussion of suitable materials for use in the recording elements used in this invention, reference will be made to the previously mentioned *Research Disclosure*, Item 308119, the disclosures' of which are incorporated herein by reference.

Suitable dispersing media for the emulsion layers and other layers of the recording elements are described in Section IX of *Research Disclosure*, Item 308119, cited above, and publications therein.

In addition to the compounds described herein, the elements of this invention can include additional dye image-forming compounds, as described in Sections VII A-E and H of *Research Disclosure*, Item 308119, cited above, and the publications cited therein.

The recording elements used in this invention can contain brighteners (Section V), antifoggants and stabilizers (Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in *Research Disclosure*, Item 308119, cited above.

The recording elements used in this invention can be coated on a variety of supports, as described in Section XVII of *Research Disclosure*, Item 308119, cited above, and references cited therein.

The recording elements used in this invention can be exposed to actinic radiation in a pixel-by-pixel mode as more fully described hereinafter to form a latent image and then processed to form a visible image, as described in Sections XVIII and XIX of *Research Disclosure*, Item 308119, cited above. Typically, processing to form a visible dye image includes the step of contacting the recording element with a color developing agent to reduce developable silver halide and oxidize the color developing agent. Oxidized color developing agent in turn reacts with the coupler to yield a dye. Preferred color developing agents are p-phenylenediamines. Especially preferred are 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride, and 4-amino-N-ethyl-N-(2-methoxyethyl)-m-toluidine di-p-toluenesulfonic acid.

With negative-working silver halide, the processing step described hereinbefore provides a negative image. The described elements can be processed in the color paper process Kodak TM Ektacolor RA-4 or Kodak TM Flexicolor color process as described in, for example, the British Journal of Photography Annual of 1988, pages 196–198. To provide a positive (or reversal) image, the color development step can be preceded by development with a non-chromogenic developing agent to develop exposed silver halide but not form dye, and then uniform fogging of the element to render unexposed silver halide developable. The Kodak TM E-6 Process is a typical reversal process. Development is followed by the conventional steps of bleaching, fixing, or bleach-fixing, to remove silver or silver halide, washing, and drying.

The recording elements of the invention can take the form of image transfer elements. Specifically, any conventional image transfer system employing a radiation-sensitive silver halide emulsion layer can by the substitution of at least one high chloride tabular grain emulsion as described above be applied to the practice of the invention. Conventional image transfer systems are summarized in *Research Disclosure*, Vol. 156, November 1976, Item 15164, and in *Research Disclosure*, 308119, cited above, Section XXIII.

Ionic separation imaging systems which utilize sulfonamidoaniline and sulfonamidophenol 0 diffusion transfer technology are specifically contemplated. Such a photographic product comprises at least one image dye providing element comprising at least one layer of a high chloride tabular grain emulsion of the type described above associated with a nondiffusible sulfonamidoaniline and sulfonamidophenol image dye providing compound. After imagewise exposure, the element is treated with an alkaline processing composition in the presence of a silver halide developing agent to produce a silver image. An imagewise distribution of oxidized developer cross-oxidizes the image dye providing compound, which, in an alkaline medium, cleaves to liberate a diffusible image dye. A preferred system of this type is disclosed in published in Fleckenstein U.S. trial voluntary protest document B351,637, dated Jan. 28, 1975. Other preferred systems are disclosed in U.S. Pat. Nos. 4,076,529, 4,450,224 and 4,463,080 and U.K. Patents 2.026,710 and 2,038,041.

Preferred sulfonamidoaniline and sulfonamidophenol image dye providing compounds are those identified by the formula:

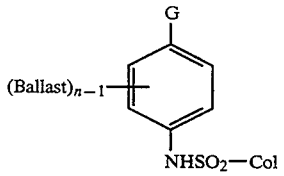

wherein

Col is a dye or dye precursor moiety;

Ballast is an organic ballasting radical of such molecular size and configuration as to render the formula compound nondifussible during development in an alkaline processing solution having a pH in excess of 11;

G is OR or NHR$_1$ wherein R is hydrogen or a hydrolyzable moiety and R$_1$ is hydrogen or an alkyl group of from 1 to 22 carbon atoms; and n is a positive integer of 1 to 2 and is 2 when G is OR or when R$_1$ is hydrogen or an alkyl group of less than 8 carbon atoms.

In one specifically preferred form Ballast includes the atoms forming a benzo ring fused with the benzene ring shown in the formula.

Examples of compounds satisfying the formula above include the following:

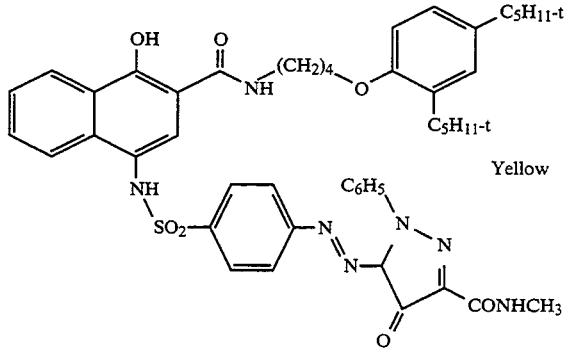

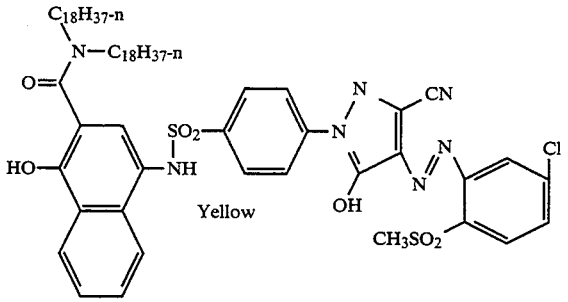

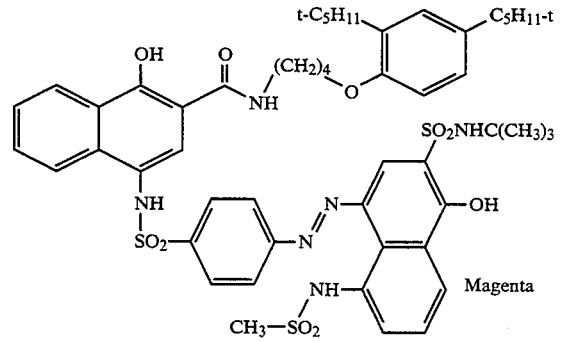

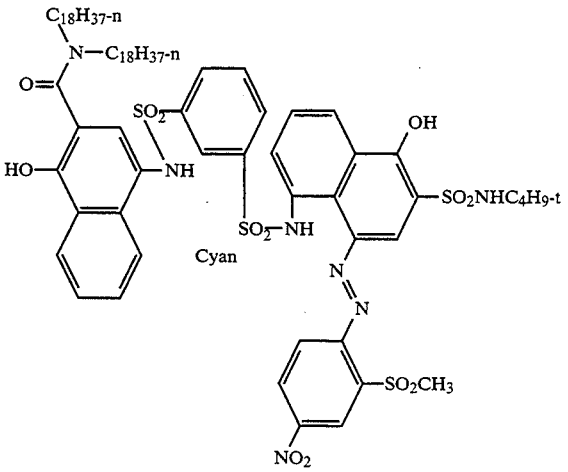

-continued

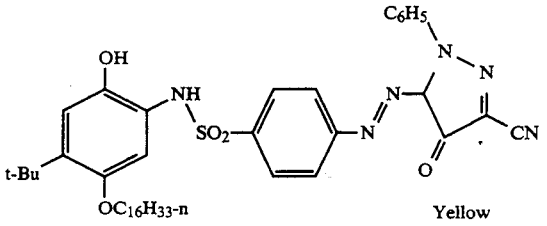

Yellow

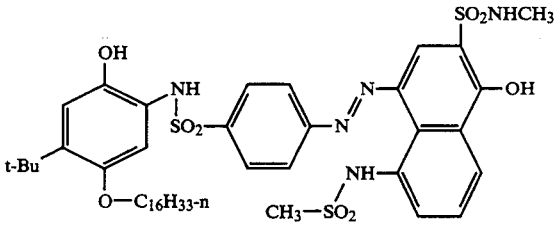

Magenta

-continued

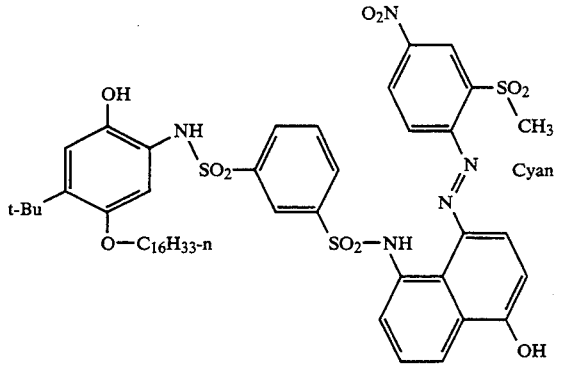

Cyan

In a similar technology, a silver halide photographic process is combined with LED exposure and thermal development/transfer resulting in a high image quality hard copy system incorporating digital exposure technology. Systems of this type are disclosed by U.S. Pat. Nos. 4,904,573, 4,952,969, 4,732,846, 4,775,613, 4,439,513, 4,473,631, 4,603,103, 4,500,626 and 4,713,319, the disclosures of which are here incorporated by reference.

Table I contains the formulas of typical dye image-forming coupler compounds that can be used in the recording elements described herein.

TABLE I

Typical Dye Image-Forming Coupler Compounds

C-1

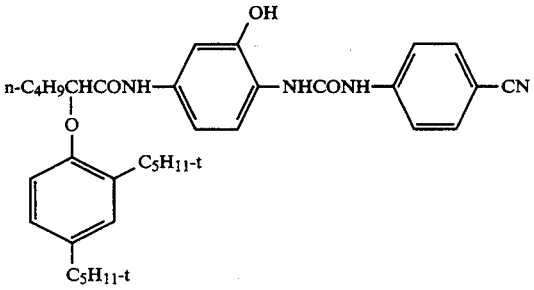

C-2

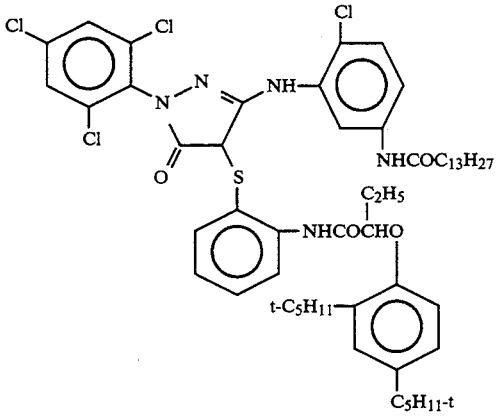

C-3

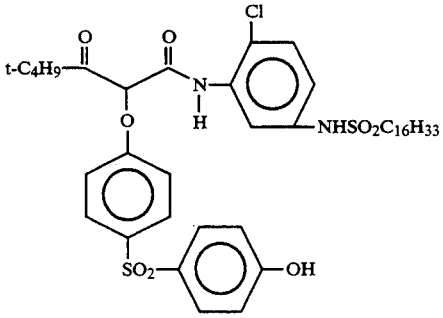

C-5

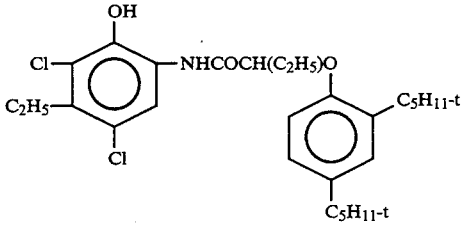

TABLE I-continued
Typical Dye Image-Forming Coupler Compounds
C-6
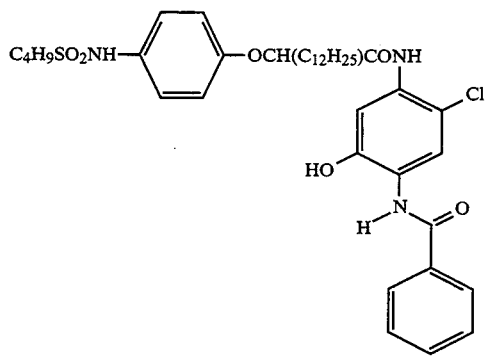
C-7
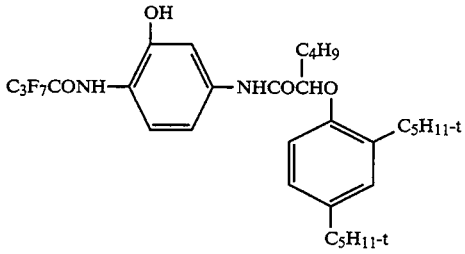
C-8
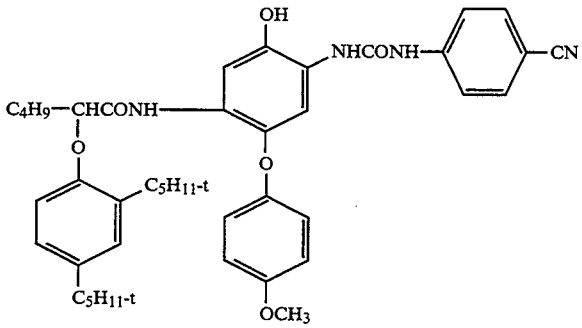
C-9
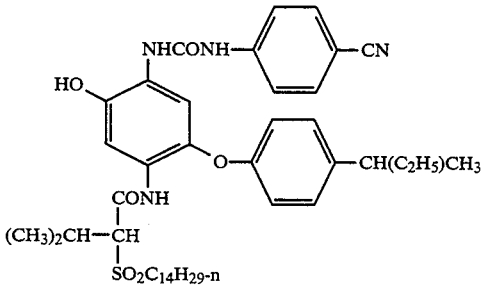
C-10
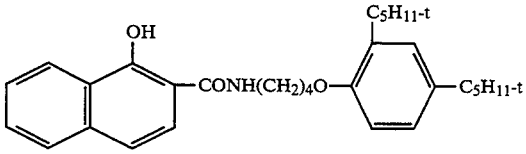
C-11
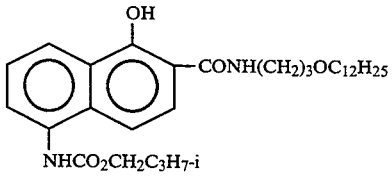
C-12
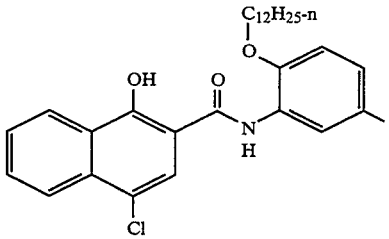
C-13
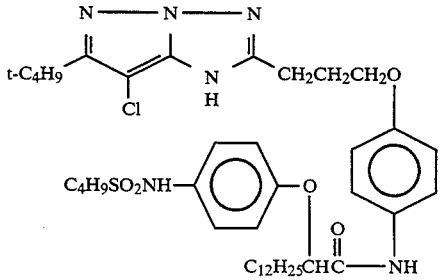

TABLE I-continued
Typical Dye Image-Forming Coupler Compounds
C-14
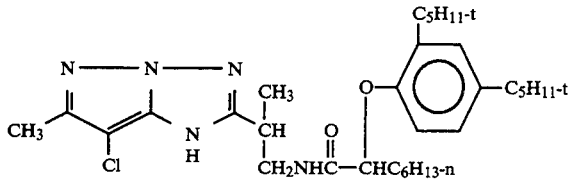
C-15
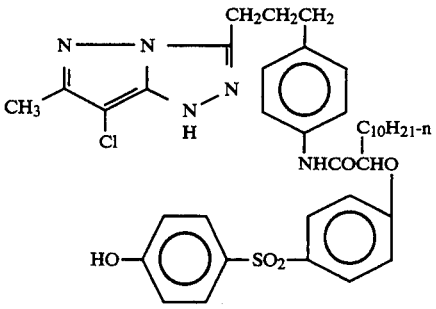
C-16
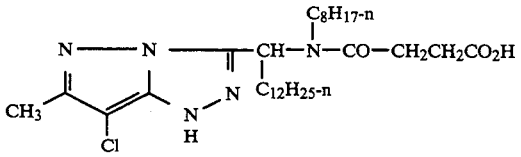
C-18
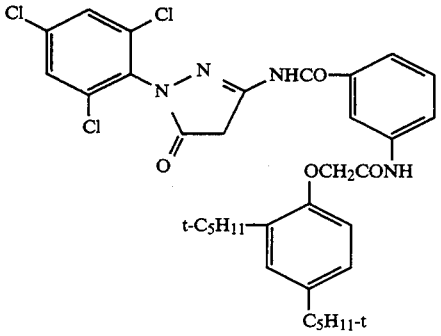
C-20
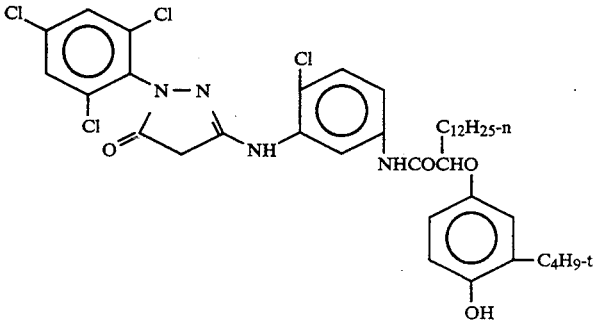

TABLE I-continued
Typical Dye Image-Forming Coupler Compounds
C-21
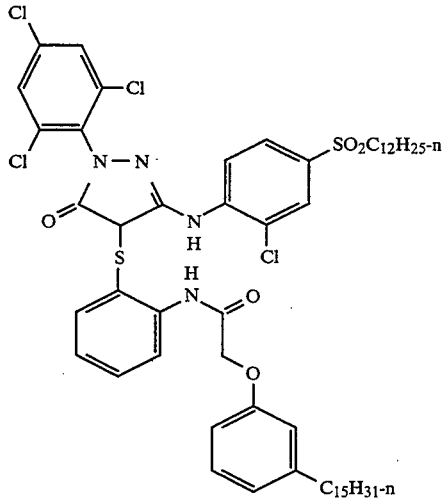
C-22
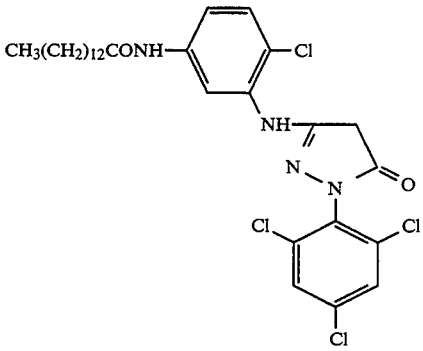
C-23
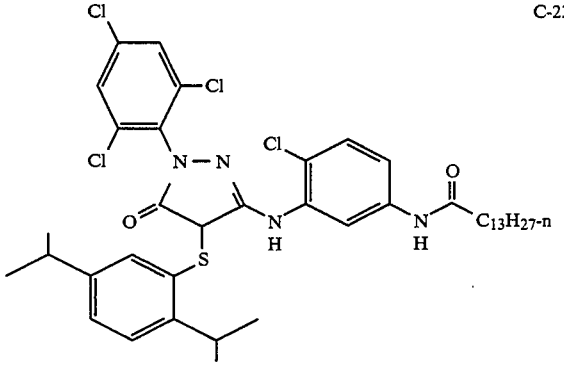
C-24
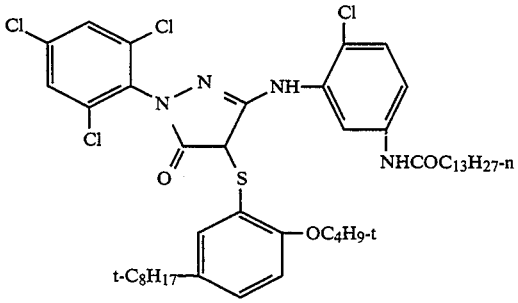
C-25
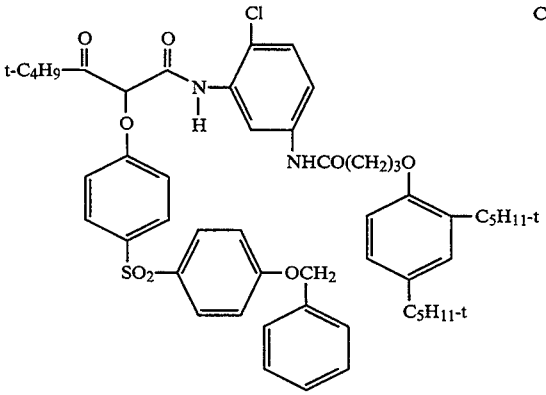
C-26
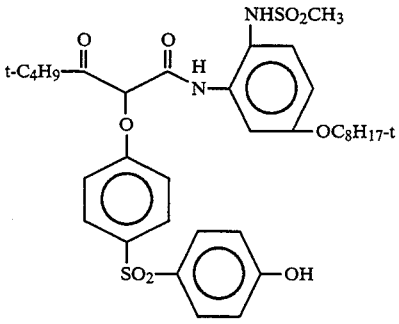
C-27
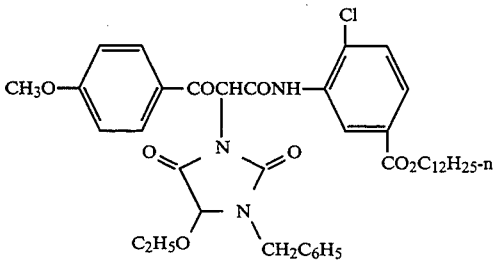
C-28
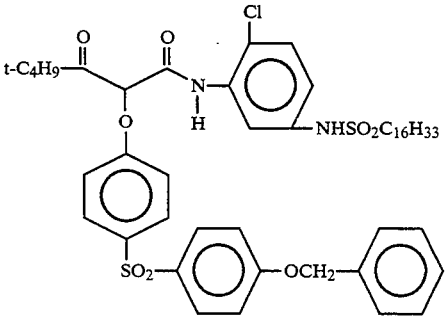

TABLE I-continued
Typical Dye Image-Forming Coupler Compounds
C-29
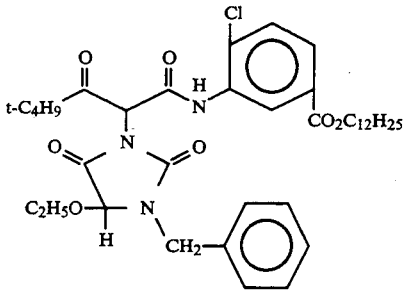
C-31
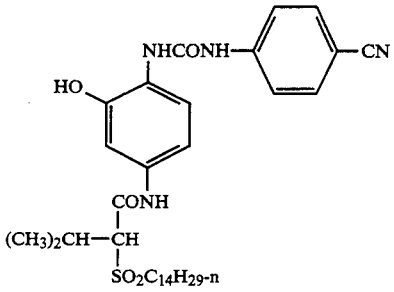
C-32
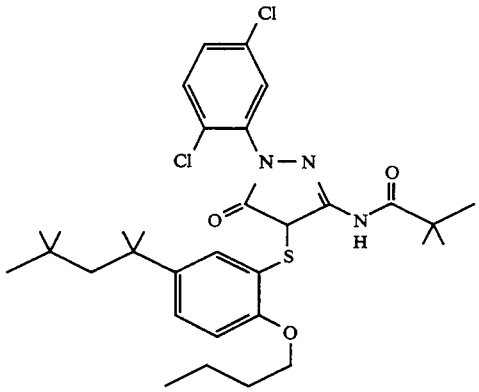
C-33
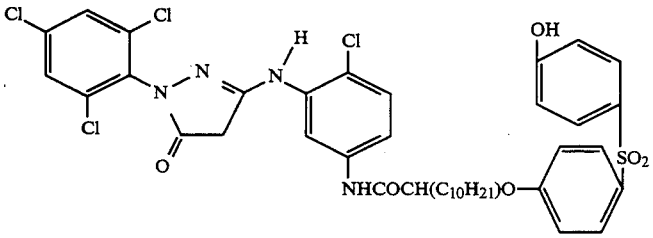
C-34
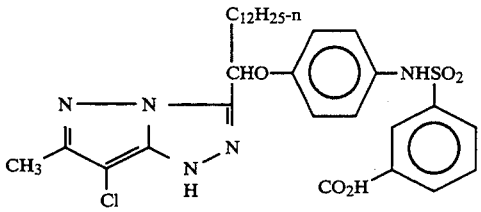
C-35
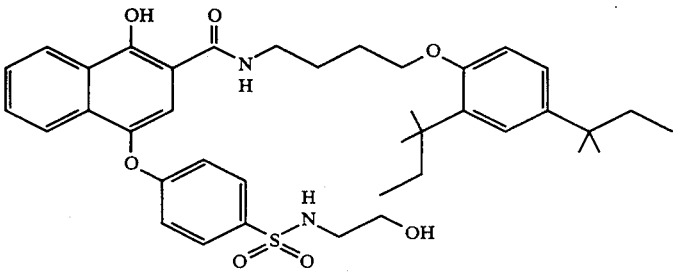

TABLE I-continued

Typical Dye Image-Forming Coupler Compounds

C-36

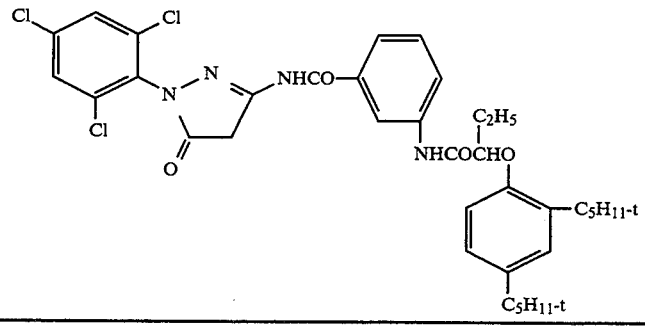

Of course, the recording elements used in the practice of this invention can contain any of the optional additional layers and components known to be useful in such recording elements in general, such as, for example, subbing layers, overcoat layers, surfactants and plasticizers, some of which are discussed in detail hereinbefore. They can be coated onto appropriate supports using any suitable technique, including, for example, those described in *Research Disclosure*, Item 308119, cited above, Section XV Coating and Drying Procedures.

As previously indicated, a recording element used in the present invention can comprise a single radiation-sensitive emulsion layer on a support. Particularly useful embodiments, however, are multicolor multilayer elements that contain a sensitized cyan dye image-forming silver halide emulsion unit, a sensitized magenta dye image-forming silver halide emulsion, and a sensitized yellow dye image-forming silver halide emulsion unit, each unit containing at least one dye image-forming compound in reactive association with a radiation-sensitive silver halide emulsion.

If desired, the recording elements can be used in conjunction with an applied magnetic layer as described in *Research Disclosure*, November 1992, Item 34390.

Apart from the features that have been specifically discussed the tabular grain emulsion preparation procedures, the tabular grains that they produce, and their further use in the recording elements described herein can take any convenient conventional form. Substitution for conventional emulsions of the same or similar silver halide composition is generally contemplated, with substitution for silver halide emulsions of differing halide composition, particularly other tabular grain emulsions, being also feasible. The low levels of native blue sensitivity of the high chloride {100} tabular grain emulsions allows such emulsions to be employed in any desired layer order arrangement in multicolor photographic elements, including any of the layer order arrangements disclosed by Kofron et al U.S. Pat. No. 4,439,520, the disclosure of which is here incorporated by reference, both for layer order arrangements and for other conventional features of photographic elements containing tabular grain emulsions. Conventional features are further illustrated by the following incorporated by reference disclosures:

| | |
|---|---|
| ICBR-1 | Research Disclosure, Vol. 308, December 1989, Item 308, 119; |
| ICBR-2 | Research Disclosure, Vol. 225, January 1983, Item 22,534; |

-continued

| | |
|---|---|
| ICBR-3 | Wey et al U.S. Pat. No. 4,414,306, issued Nov. 8, 1983; |
| ICBR-4 | Solberg et al U.S. Pat. No. 4,433,048, issued Feb. 21, 1984; |
| ICBR-5 | Wilgus et al U.S. Pat. No. 4,434,226, issued Feb. 28, 1984; |
| ICBR-6 | Maskasky U.S. Pat. No. 4,435,501, issued Mar. 6, 1984; |
| ICBR-7 | Maskasky U.S. Pat. No. 4,643,966, issued Feb. 17, 1987; |
| ICBR-8 | Daubendiek et al U.S. Pat. No. 4,672,027, issued Jan. 9, 1987; |
| ICBR-9 | Daubendiek et al U.S. Pat. No. 4,693,964, issued Sept. 15, 1987; |
| ICBR-10 | Maskasky U.S. Pat. No. 4,713,320, issued Dec. 15, 1987; |
| ICBR-11 | Saitou et al U.S. Pat. No. 4,797,354, issued Jan. 10, 1989; |
| ICBR-12 | Ikeda et al U.S. Pat. No. 4,806,461, issued Feb. 21, 1989; |
| ICBR-13 | Makino et al U.S. Pat. No. 4,853,322, issued Aug. 1, 1989; and |
| ICBR-14 | Daubendiek et al U.S. Pat. No. 4,914,014, issued Apr. 3, 1990. |

The recording elements comprising the radiation sensitive high chloride {100} tabular grain emulsion layers according to this invention can be imagewise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to 5 which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source need, of course, provide radiation in only one spectral region if the recording element is a monochrome element sensitive to only that region (color) of the electromagnetic spectrum. Suitable light emitting diodes and commercially available laser sources are described in the examples. Imagewise exposures at ambient, elevated or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18 and 23.

The quantity or level of high energy actinic radiation provided to the recording medium by the exposure source is generally at least $10^{-4}$ erg/cm$^2$, typically in the range of about $10^{-4}$ erg/cm$^2$ to $10^3$ ergs/cm$^2$ and often from $10^{-3}$ erg/cm$^2$ to $10^2$ ergs/cm$^2$. Exposure of the recording element in a pixel-by-pixel mode as known in the prior art persists for only a very short duration or time. Typical maximum exposure times are up to 100 microseconds, often up to 10 microseconds, and frequently up to only 0.5 microsecond. As illustrated by the following Examples, excellent results are achieved with a laser beam at an exposure time of only 0.05 microsecond, and still lower exposure times down to 0.01 microsecond are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer,* Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, published European Patent Applications 479 167 A1 and 502 508 A1, the disclosures of which are hereby incorporated herein by reference.

A suitable multicolor, multilayer format for a recording element used in the electronic printing method of this invention is represented by Structure I.

Blue-sensitized
yellow dye image-forming silver halide emulsion unit
Interlayer
Green-sensitized
magenta dye image-forming silver halide emulsion unit
Interlayer
Red-sensitized
cyan dye image-forming silver halide emulsion unit
///// Support /////
STRUCTURE I wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are typically separated from each other by interlayers, as shown.

In the practice of the present invention, a tabular silver chloride emulsion containing grains bounded by {100} major faces and in reactive association with a dye image-forming compound can be contained in the blue-sensitized silver halide emulsion unit only, or it can be contained in each of the silver halide emulsion units.

Another useful multicolor, multilayer format for an element of the invention is the so-called inverted layer order represented by Structure II.

Green-sensitized
magenta dye image-forming silver halide emulsion unit
Interlayer
Red-sensitized
cyan dye image-forming silver halide emulsion unit
Interlayer
Blue-sensitized
yellow dye image-forming silver halide emulsion unit
///// Support /////
STRUCTURE II wherein the blue-sensitized, yellow dye image-forming silver halide unit is situated nearest the support, followed next by the red-sensitized, cyan dye image-forming unit, and uppermost the green-sensitized, magenta dye image-forming unit. As shown, the individual units are typically separated from one another by interlayers.

As described above for Structure I, a silver chloride emulsion containing tabular grains bounded by {100} major faces can be located in the blue-sensitized silver halide emulsion unit, or it can be in each of the units.

Still another suitable multicolor, multilayer format for an element of the invention is illustrated by Structure III.

Red-sensitized
cyan dye image-forming silver halide emulsion unit
Interlayer
Green-sensitized
magenta dye image-forming silver halide emulsion unit
Interlayer
Blue-sensitized
yellow dye image-forming silver halide emulsion unit
///// Support /////
Structure III wherein the blue-sensitized, yellow dye image-forming silver halide unit is situated nearest the support, followed next by the green-sensitized, magenta dye image-forming unit, and uppermost the red-sensitized, cyan dye image-forming unit. As shown, the individual units are typically separated from one another by interlayers.

As described above for Structures I and II, a silver chloride emulsion containing tabular grains bounded by {100} major faces can be located in the blue-sensitized silver halide emulsion unit, or it can be in each of the units.

Three additional useful multicolor, multilayer formats are represented by Structures IV, V, and VI.

$IR^1$ - sensitized
yellow dye image-forming silver halide emulsion unit
Interlayer
$IR^2$ - sensitized
magenta dye image-forming silver halide emulsion unit
Interlayer
$IR^3$ - sensitized
cyan dye image-forming silver halide emulsion unit
///// Support /////
STRUCTURE IV $IR^1$ - sensitized
magenta dye image-forming silver halide emulsion unit
Interlayer
$IR^2$ - sensitized
cyan dye image-forming silver halide emulsion unit -continued Interlayer
$IR^3$ - sensitized
yellow dye image-forming silver halide emulsion unit
///// Support /////
STRUCTURE V $IR^1$ - sensitized
cyan dye image-forming silver halide emulsion unit
Interlayer
$IR^2$ - sensitized
magenta dye image-forming silver halide emulsion unit
Interlayer
$IR^3$ - sensitized
yellow dye image-forming silver halide emulsion unit
///// Support /////
STRUCTURE VI Structures IV, V, and VI are analogous to the above-described Structures I, II and III, respectively, except that the three emulsion units are sensitized to different regions of the infrared (IR) spectrum. Alternatively, only one or two of the emulsion units in Structures IV, V, and VI may be IR-sensitized, the remaining unit(s) being sensitized in the visible. As with Structures I, II, and III, Structures IV, V, and VI may contain a silver chloride emulsion containing tabular grains bounded by {100} major faces in the uppermost silver halide emulsion unit, or in the lowermost emulsion unit, or in each of the silver halide emulsion units. Also, as previously discussed, the emulsion units of Structures I–VI can individually comprise a multiplicity of silver halide emulsion layers of differing sensitivity and grain morphology.

EXAMPLES

The invention can be better appreciated by reference to the following Examples. Examples 1–21 illustrate the preparation of radiation sensitive high chloride {100} tabular grain emulsions that can be used in the practice of this invention. Examples 22–38 illustrate that recording elements containing layers of such emulsions exhibit characteristics which make them particularly useful in electronic printing methods of the type described herein.

Example 1—Effect of Iodide on Nucleation Step of Silver Chloride Grain Morphology An ultrathin tabular grain silver iodochloride emulsion satisfying the requirements of this invention was prepared as follows:

A 2030 mL solution containing 1.75 percent by weight low methionine gelatin, 0.011M sodium chloride and $1.48\times10^{-4}$M potassium iodide was provided in a stirred reaction vessel. The contents of the reaction vessel were maintained at 40° C. and the pCl was 1.95.

While this solution was vigorously stirred, 30 mL of 1.0M silver nitrate solution and 30 mL of a 0.99M sodium chloride and 0.01M potassium iodide solution were added simultaneously at a rate of 30 mL/min each. This achieved grain nucleation to form crystals with an initial iodide concentration of 2 mole percent, based on total silver.

The mixture was then held 10 minutes, the temperature remaining at 40° C. Following the hold, a 1.0M silver nitrate solution and a 1.0M NaCl solution were added simultaneously at 2 mL/min for 40 minutes with the pCl being maintained at 1.95.

The resulting emulsion was a tabular grain silver iodochloride emulsion containing 0.5 mole percent iodide, based on silver. Fifty percent of total grain projected area was provided by tabular grains having {100} major faces having an average ECD of 0.84 μm and an average thickness of 0.037 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 23 and an average tabularity ($ECD/t^2$) of 657. The ratio of major face edge lengths of the selected tabular grains was 1.4. Seventy two percent of total grain projected area was made up of tabular grains having {100} major faces and aspect ratios of at least 7.5. These tabular grains had a mean ECD of 0.75 μm, a mean thickness of 0.045 μm, a mean aspect ratio of 18.6 and a mean tabularity of 488.

A representative sample of the grains of the emulsion is shown in FIG. 1.

The preparation of the following control emulsion demonstrates the effect of omitting iodide in the precipitation of the initial grain population (nucleation).

The same precipitation procedure as that just described was used, except that no iodide was intentionally added.

The resulting emulsion consisted primarily of cubes and very low aspect ratio rectangular grains ranging in size from about 0.1 to 0.5 μm in edge length. A small number of large rods and high aspect ration {100} tabular grains were present, but did not constitute a useful quantity of the grain population.

A representative sample of the grains of this comparative emulsion is shown in FIG. 2.

Example 2—Preparation of Tabular Grain Silver Iodochloride Emulsion T-1

A tabular grain silver iodochloride emulsion was precipitated as follows:

A 4500 mL solution containing 3.5 percent by weight of low methionine gelatin, 0.0056 mol/L of sodium chloride and $3.4\times10^{-4}$ mol/L of potassium iodide was provided in a stirred reaction vessel. The contents of the reaction vessel were maintained at 40° C., and the pCl was 2.25.

While this solution was vigorously stirred, 90 mL of 2.0M silver nitrate solution and 90 mL of a 1.99M sodium chloride were added simultaneously at a rate of 180 mL/min each.

The mixture was then held for 3 minutes, the temperature remaining at 40° C. Following the hold, a 0.5M silver nitrate solution and a 0.5M sodium chloride solution were added simultaneously at 24 mL/min for 40 minutes, the pCl being maintained at 2.25. The 0.5M silver nitrate solution and the 0.5M sodium chloride solution were then added simultaneously with a ramped linearly increasing flow from 24 mL/min to 37.1 mL/min over 70 minutes, the pCl being maintained at 2.25. Finally, 0.75M silver nitrate solution and 0.75M sodium chloride solution were added at constant rate of 37.1 mL/min over 90 minutes, the pCl being maintained at 2.25. The emulsion was then washed using an ultrafiltration unit, and its final pH and pCl were adjusted to 5.5 and 1.8, respectively.

The resulting emulsion was a tabular grain silver iodochloride emulsion containing 0.06 mole percent iodide, based on silver. More than 50 percent of total grain projected area was provided by tabular grains having {100} major faces with an average ECD of 1.55 μm and an average thickness of 0.155 μm.

Example 3—Preparation of Tabular Grain Silver Iodochloride Emulsion T-2

A tabular grain silver iodochloride emulsion was precipitated as described in Example 2, except that 20 molar ppm of $K_4Ru(Cl)_6$ was added during the precipitation.

The resulting emulsion contained 0.06 mole percent iodide, based on silver. More than 50 percent of the total grain projected area was provided by tabular grains having {100} major faces, with an average ECD of 1.42 μm and an average thickness of 0.146 μm.

Example 4—Preparation of Tabular Grain Silver Iodochloride Emulsion T-3

A tabular grain silver iodochloride emulsion was precipitated as described in Example 2, then washed by ultrafiltration. Its final pH and pCl were adjusted to 5.6 and 1.8, respectively.

More than 50 percent of the total grain projected area of the resulting emulsion was provided by tabular grains having {100} major faces, with an average ECD of 1.38 μm and an average thickness of 0.148 μm. The emulsion contained 0.06 mole percent iodide, based on silver.

Example 5—Preparation of Tabular Grain Silver Iodochloride Emulsion T-4

A tabular grain silver iodochloride emulsion was precipitated as described in Example 2, then washed by ultrafiltration. The final pH and pCl were adjusted to 5.6 and 1.8, respectively.

The resulting emulsion contained 0.06 mole percent iodide, based on silver. More than 50 percent of the total grain projected area was provided by tabular grains having {100} major faces, with an average ECD of 1.61 μand an average thickness of 0.15 μm.

Example 6—Preparation of Tabular Grain Silver Iodochloride Emulsion T-5

This example demonstrates an emulsion according to the invention in which 90 percent of the total grain projected area is comprised of tabular grains with {100} major faces and aspect ratios of greater than 7.5.

A 2030 mL solution containing 3.52 percent by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.25.

While this solution was vigorously stirred, 30 mL of 2.0M silver nitrate solution and 30 mL of a 1.99M sodium chloride and 0.01M potassium iodide solution were added simultaneously at a rate of 60 mL/min each. This achieved grain nucleation to form crystals with an initial iodide concentration of 1 mole percent, based on total silver.

The mixture was then held for 10 minutes, the temperature remaining at 40° C. Following the hold, a 0.5M silver nitrate solution and a 0.5M NaCl solution were added simultaneously at 8 mL/min for 40 minutes with the pCl being maintained at 2.25. The 0.5M $AgNO_3$ solution and the 0.5M NaCl solution were then added simultaneously with a ramped linearly increasing flow from 8 mL per minute to 16 mL per minute over 130 minutes with the pCl maintained at 2.25.

The resulting emulsion was a tabular grain silver iodochloride emulsion containing 0.06 mole percent iodide, based on silver. Fifty percent of total grain projected area was provided by tabular grains having {100} major faces having an average ECD of 1.86 μand an average thickness of 0.082 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 24 and an average tabularity ($ECD/t^2$) of 314. The ratio of major face edge lengths of the selected tabular grains was 1.2. Ninety three percent of total grain projected area was made up of tabular grains having {100} major faces and aspect ratios of at least 7.5. These tabular grains had a mean ECD of 1.47 μm, a mean thickness of 0.086 μm, a mean aspect ratio of 17.5 and a mean tabularity of 222.

Example 7—Preparation of Tabular Grain Silver Iodochloride Emulsion T-6

This example demonstrates an emulsion prepared similarly to the emulsion of Example 6, but an initial 0.08 mole percent iodide and a final 0.04 percent iodide.

A 2030 mL solution containing 3.52 percent by weight low methionine gelatin, 0.0056M sodium chloride and $3.00\times10^{-5}$M potassium iodide was provided in a stirred reaction vessel. The contents of the reaction vessel were maintained at 40° C. and the pCl was 2.25.

While this solution was vigorously stirred, 30 mL of 5.0M silver nitrate solution and 30 mL of a 4.998M sodium chloride and 0.002M potassium iodide solution were added simultaneously at a rate of 60 mL/min each. This achieved grain nucleation to form crystals with an initial iodide concentration of 0.08 mole percent, based on total silver.

The mixture was then held for 10 minutes, the temperature remaining at 40° C. Following the hold, a 0.5M silver nitrate solution and a 0.5M sodium chloride solution were added simultaneously at 8 mL/min for 40 minutes with the pCl being maintained at 2.25.

The resulting emulsion was a tabular grain silver iodochloride emulsion containing 0.04 mole percent iodide, based on silver. Fifty percent of the total grain projected area was provided by tabular grains having {100} major faces having an average ECD of 0.67 μm and an average thickness of 0.035 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 20 and an average tabularity ($ECD/t^2$) of 651. The ratio of major face edge lengths of the selected tabular grains was 1.9. Fifty two percent of total grain projected area was made up of tabular grains having {100} major faces and aspect ratios of at least 7.5. These tabular grains had a mean ECD of 0.63 μm, a mean thickness of 0.036 μm, a mean aspect ratio of 18.5 and a mean tabularity of 595.

Example 8—Preparation of Tabular Grain Silver Iodochloride Emulsion T-7

This example demonstrates an emulsion in which the initial grain population contained 6.0 mole percent iodide and the final emulsion contained 1.6 percent iodide.

A 2030 mL solution containing 3.52 percent by weight low methionine gelatin, 0.0056M sodium chloride and $3.00\times10^{-5}$M potassium iodide was provided in a stirred reaction vessel. The contents of the reaction vessel were maintained at 40° C. and the pCl was 2.25.

While this solution was vigorously stirred, 30 mL of 1.0M silver nitrate solution and 30 mL of a 0.97M sodium chloride and 0.03M potassium iodide solution were added simultaneously at a rate of 60 mL/min each. This achieved grain nucleation to form crystals with an initial iodide concentration of 6.0 mole percent, based on total silver.

The mixture was then held for 10 minutes, the temperature remaining at 40° C. Following the hold, a 1.00M silver nitrate solution and a 1.00M sodium chloride solution were added simultaneously at 2 mL/min for 40 minutes with the pCl being maintained at 2.25.

The resulting emulsion was a tabular grain silver iodochloride emulsion containing 1.6 mole percent iodide, based on silver. Fifty percent of total grain projected area was provided by tabular grains having {100} major faces having an average ECD of 0.57 μm and an average thickness of 0.036 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 16.2 and an average tabularity ($ECD/t^2$) of 494. The ratio of major face edge lengths of the selected tabular grains was 1.9. Sixty two percent of total grain projected area was made up of tabular grains having {100} major faces and aspect ratios of at least 7.5. These tabular grains had a mean ECD of 0.55 μm, a mean thickness of 0.041 μm, a mean aspect ratio of 14.5 and a mean tabularity of 421.

Example 9—Preparation of Tabular Grain Silver Iodochloride Emulsion T-8

This example demonstrates an ultrathin high aspect ratio {100} tabular grain emulsion in which 2 mole percent iodide is present in the initial population and additional iodide is added during growth to make the final iodide level 5 mole percent.

A 2030 mL solution containing 1.75 percent by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.3.

While this solution was vigorously stirred, 30 mL of 1.0M silver nitrate solution and 30 mL of a 0.99M sodium chloride and 0.01M potassium iodide solution were added simultaneously at a rate of 90 mL/min each. This achieved grain nucleation to form crystals with an initial iodide concentration of 2 mole percent, based on total silver.

The mixture was then held for 10 minutes, the temperature remaining at 40° C. Following the hold, a 1.00M silver nitrate solution and a 1.00M sodium chloride solution were added simultaneously at 8 mL/min while a $3.75\times10^{-3}$M potassium iodide was simultaneously added at 14.6 mL/min for 10 minutes with the pCl being maintained at 1.95.

The resulting emulsion was a tabular grain silver iodochloride emulsion containing 5 mole percent iodide, based on silver. Fifty percent of total grain projected area was provided by tabular grains having {100} major faces having an average ECD of 0.58 μm and an average thickness of 0.030 μm, selected on the basis of an aspect ratio rank ordering of all {100} tabular grains having a thickness of less than 0.3 μm and a major face edge length ratio less than 10. The selected tabular grain population had an average aspect ratio (ECD/t) of 20.6 and an average tabularity ($ECD/t^2$) of 803. The ratio of major face edge lengths of the selected tabular grains was 2. Eighty seven percent of total grain projected area was made up of tabular grains having {100} major faces and aspect ratios of at least 7.5. These tabular grains had a mean ECD of 0.54 μm, a mean thickness of 0.033 μm, a mean aspect ratio of 17.9 and a mean tabularity of 803.

Example 10—Preparation of Tabular Grain Silver Iodobromochloride Emulsion T-9

This example demonstrates a high aspect ratio (100) tabular emulsion where 1 mole percent iodide is present in the initial grain population and 50 mole percent bromide, is added during growth to make the final emulsion 0.3 mole percent iodide, 36 mole percent bromide, and 63.7 mole percent chloride.

A 2030 mL solution containing 3.52 percent by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.25.

While this solution was vigorously stirred, 30 mL of 1.0M silver nitrate solution and 30 mL of a 0.99M sodium chloride and 0.01M potassium iodide solution were added simultaneously at a rate of 60 mL/min each. This achieved grain nucleation.

The mixture was then held for 10 minutes, the temperature remaining at 40° C. Following the hold, a 0.5M silver nitrate solution and a 0.25M sodium chloride and 0.25M sodium bromide solution were added simultaneously at 8 mL/min for 40 minutes with the pCl being maintained at 2.25 to form crystals with an initial iodide concentration of 2 mole percent, based on total silver.

The resulting emulsion was a tabular grain silver iodobromochloride emulsion containing 0.27 mole percent iodide and 36 mole percent bromide, based on silver, the remaining halide being chloride. Fifty percent of total grain projected area was provided by tabular grains having {100} major faces having an average ECD of 0.4 μm and an average thickness of 0.032 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 12.8 and an average tabularity ($ECD/t^2$) of 432. The ratio of major face edge lengths of the selected tabular grains was 1.9. Seventy one percent of total grain projected area was made up of tabular grains having {100} major faces and aspect ratios of at least 7.5. These tabular grains had a mean ECD of 0.38 μm, a mean thickness of 0.034 μm, a mean aspect ratio of 11.3 and a mean tabularity of 363.

Example 11—Preparation of Tabular Grain Silver Iodochloride Emulsion T-10

This example demonstrates the preparation of an emulsion, employing phthalated gelatin as a peptizer, that satisfies the requirements of the invention.

To a stirred reaction vessel containing a 310 mL solution that is 1.0 percent by weight phthalated gelatin, 0.0063M sodium chloride and $3.1\times10^{-4}$M KI at 40° C., 6.0 mL of a 0.1M silver nitrate aqueous solution and 6.0 mL of a 0.11M sodium chloride solution were each added concurrently at a rate of 6 mL/min.

The mixture was then held for 10 minutes, the temperature remaining at 40° C. Following the hold, the silver and salt solutions were added simultaneously with a linearly accelerated flow from 3.0 mL/min to 9.0 mL/min over 15 minutes with the pCl of the mixture being maintained at 2.7.

The resulting emulsion was a high aspect ratio tabular grain silver iodochloride emulsion. Fifty percent of total grain projected area was provided by tabular grains having {100} major faces having an average ECD of 0.37 μm and an average thickness of 0.037 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 10 and an average tabularity ($ECD/t^2$) of 330. Seventy percent of total grain projected area was made up of tabular grains having {100} major faces and aspect ratios of at least 7.5. These tabular grains had a mean ECD of 0.3 μm, a mean thickness of 0.04 μm, and a mean tabularity of 210.

Electron diffraction examination of the square and rectangular surfaces of the tabular grains confirmed major face {100} crystallographic orientation.

Example 12—Preparation of Tabular Grain Silver Iodochloride Emulsion T-11

This example demonstrates the preparation of an emulsion, employing an unmodified bone gelatin as a peptizer, that satisfies the requirements of the invention.

To a stirred reaction vessel containing a 2910 mL solution that is 0.69 percent by weight bone gelatin, 0.0056M sodium chloride, $1.86\times10^{-4}$M KI and at 55° C. and pH 6.5, 60 mL of a 4.0M silver nitrate solution and 60.0 mL of a 4.0M silver chloride solution were each added concurrently at a rate of 120 mL/min.

The mixture was then held for 5 minutes during which a 5000 mL solution that is 16.6 g/L of low methionine gelatin was added and the pH was adjusted to 6.5 and the pCl to 2.25. Following the hold, the silver and salt solutions were added simultaneously with a linearly accelerated flow from 10 mL/min to 25.8 mL/min over 63 minutes, the pCl of the mixture being maintained at 2.25.

The resulting emulsion was a high aspect ratio tabular grain silver iodochloride emulsion containing 0.01 mole percent iodide. About 65 percent of the total projected grain area was provided by tabular grains having an average ECD of 1.5 μm and an average thickness of 0.18 μm.

Example 13—Preparation of Tabular Grain Silver Chloride Emulsion T-12

A stirred reaction vessel containing 400 mL of a solution which was 0.5 percent in bone gelatin, 6 mM in 3-amino-1H-1,2,4-triazole, 0.040M in NaCl, and 0.20M in sodium acetate was adjusted to pH 6.1 at 55° C. To this solution at 55° C. were added simultaneously 5.0 mL of 4M $AgNO_3$ and 5.0 mL of 4M NaCl at a rate of 5 mL/min each. The temperature of the mixture was then increased to 75° C. at a constant rate, which required 12 minutes. After holding at this temperature for 5 minutes, the pH was adjusted to 6.2 and held to within ±0.1 of this value; the flow of the $AgNO_3$ solution was resumed at 5 mL/min until 0.8 mole of silver had been added. The flow of the NaCl solution was also resumed at a rate needed to maintain a constant pAg of 6.64.

The resulting AgCl emulsion consisted of tabular grains having {100} major faces which made up 65 percent of the projected area of the total grain population. This tabular grain population had a mean ECD of 1.95 μm and a mean thickness of 0.165 μm. The average aspect ratio and tabularity were 11.8 and 71.7, respectively.

Example 14—Preparation of Tabular Grain Silver Chloride Emulsion T-13

This emulsion was prepared similar to that of Example 13, except that the precipitation was stopped when 0.4 mole of Ag had been added.

The resulting emulsion consisted of tabular grains having {100} major faces which made up 65 percent of the projected area of the total grain population. This tabular grain population had a mean ECD of 1.28 μm and a mean thickness of 0.130 μm. The average aspect ratio and tabularity were 9.8 and 75.7, respectively.

Example 15—Preparation of Tabular Grain Silver Chloride Emulsion T-14

This example was prepared similar to that of Example 14, except that the pH of the reaction vessel was adjusted to 3.6 for the last 95 percent of the $AgNO_3$ addition.

The resulting emulsion consisted of {100} tabular grains making up 60 percent of the projected area of the total grain population. This tabular grain population had a mean ECD of 1.39 μm, and a mean thickness of 0.180 μm. The average aspect ratio and tabularity were 7.7 and 43.0, respectively.

Example 16—Preparation of Tabular Grain Silver Bromochloride Emulsion T-15

This emulsion was prepared similar to that of Example 14, except that the salt solution was 3.6M in NaCl and 0.4M in NaBr.

The resulting AgBrCl (10 percent Br) emulsion consisted of {100} tabular grains making up 52 percent of the projected area of the total grain population. This tabular grain population had a mean equivalent circular diameter of 1.28 μm, and a mean thickness of 0.115 μm. The average aspect ratio and tabularity were 11.1 and 96.7, respectively.

Example 17—Preparation of Tabular Grain Silver Chloride Emulsion T-16

This emulsion was prepared similar to that of Example 13, except that 3,5-diamino-1,2,4-triazole (2.4 mmole) was used as the {100} tabular grain nucleating agent.

The resulting AgCl emulsion consisted of tabular grains having {100} major faces which made up 45 percent of the projected area of the total grain population. This tabular grain population had a mean ECD of 1.54 μm and a mean thickness of 0.20 μm. The average aspect ratio and tabularity were 7.7 and 38.5, respectively.

Example 18—Preparation of Tabular Grain Silver Chloride Emulsion T-17

This emulsion was prepared in a manner similar to that of Example 13, except that imidazole (9.6 mmole) was used as the {100} tabular grain nucleating agent.

The resulting AgCl emulsion consisted of tabular grains having {100} major faces which made up 40 percent of the projected area of the total grain population. This tabular grain population had a mean ECD of 2.20 μm and a mean thickness of 0.23 μm. The average aspect ratio and tabularity were 9.6 and 41.6, respectively.

Example 19—Preparation of Tabular Grain Silver Chloride Emulsion T-18

To a stirred reaction vessel containing 400 mL of a solution at 85° C. and pH 6.2 that was 0.25 weight percent in bone gelatin of low methionine content (<4 μmoles per gram of gelatin) and 0.008M in NaCl were added simultaneously a 4M $AgNO_3$ solution at 5.0 ml/min and a 4M NaCl solution at a rate needed to maintain a constant pCl of 2.09. When 0.20 mole of $AgNO_3$ had been added, the additions were stopped for 20 seconds, during which time 15 mL of a 13.3 percent low methionine gelatin solution was added and the pH was adjusted to 6.2. The additions were resumed until a total of 0.4 mole of $AgNO_3$ had been added. The pH was held constant at 6.2±0.1 during the precipitation.

The resulting AgCl emulsion consisted of tabular grains having {100} major faces which made up 40 percent of the projected area of the total grain population. This tabular grain population had a mean equivalent circular diameter of 2.18 μm and a mean thickness of 0.199 μm. The average aspect ratio and tabularity were 11.0 and 55.0, respectively.

Example 20—Preparation of Tabular Grain Silver Iodochloride Emulsion T-19

A tabular grain silver iodochloride emulsion was precipitated as follows:

A 45 L solution containing 3.5 percent by weight of low methionine gelatin, 0.0028 mol/L of sodium chloride and $5.6\times10^{-4}$ mol/L of potassium iodide was provided in a stirred reaction vessel. The contents of the reaction vessel were maintained at 40° C., and the pCl was 2.25.

While this solution was vigorously stirred, 1.4 L of 1.25M silver nitrate solution and 1.4 L of a 1.25M sodium chloride were added simultaneously at a rate of 2.8 mL/min each.

The mixture was then held for 1.5 minutes, the temperature remaining at 40° C. Following the hold, a 0.625M silver nitrate solution and a 0.625M sodium chloride solution were added simultaneously at 280 mL/min for 30 minutes, the pCl being maintained at 2.25. The 0.625M silver nitrate solution and the 0.625M sodium chloride solution were then added simultaneously with a ramped linearly increasing flow from 280 mL/min to 420 mL/min over 125 minutes, the pCl being maintained at 2.25. Finally, the growth was completed until 42.2 moles of emulsion was produced. The emulsion was then washed using an ultrafiltration unit, and its final pH and pCl were adjusted to 5.5 and 1.8, respectively.

The resulting emulsion was a tabular grain silver iodochloride emulsion containing 0.06 mole percent iodide, based on silver. More than 50 percent of total grain projected area was provided by tabular grains having {100} major faces with an average ECD of 1.47 μm and an average thickness of 0.162 μm.

Example 21—Preparation of Tabular Grain Silver Iodochloride Emulsion T-20

A tabular grain silver iodochloride emulsion was precipitated as described in Example 20, except that 448 mL of 0.5M potassium iodide solution was dumped into the emulsion 10 minutes before the end of precipitation and antifoggants amounts of mercuric chloride was added to the silver nitrate solutions .

The resulting emulsion was a tabular grain silver iodochloride emulsion containing 0.59 mole percent iodide, based on silver. More than 50 percent of total grain projected area was provided by tabular grains having {100} major faces with an average ECD of 1.35 μm and an average thickness of 0.159 μm.

The sensitizing dyes and supersensitizing compound shown below are employed in the Examples to follow:

SS-52

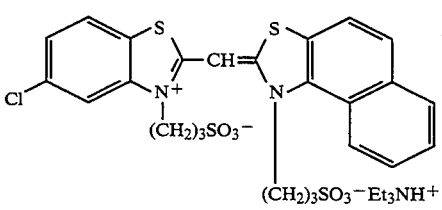

SS-53

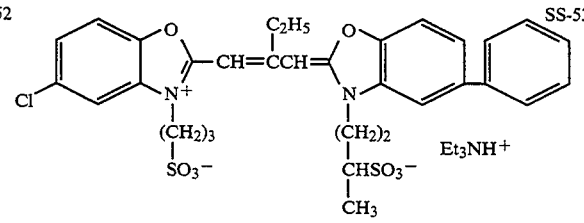

SS-54

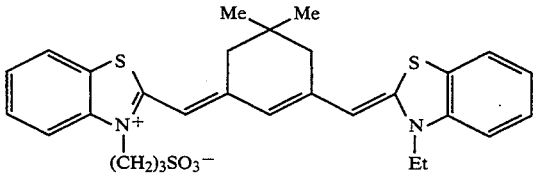

SS-55

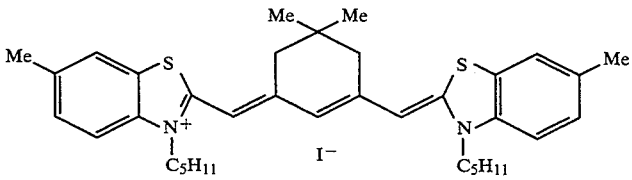

-continued

SS-56

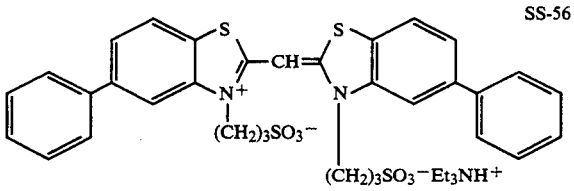

SS-57

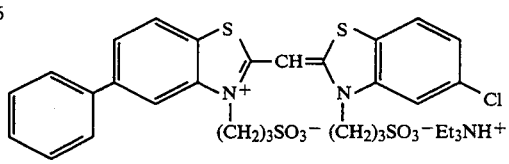

SU-1

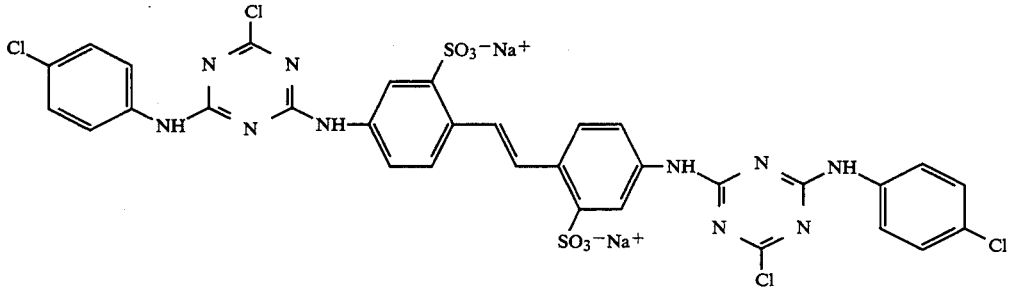

Example 22—Preparation, Exposure, and Processing of Recording Elements

The tabular grain silver chloride emulsion T-1 of Example 2 was blue-sensitized as follows: 624 mg/silver mole of sensitizing dye SS-52 was added to the emulsion. After holding for 20 minutes, 2.4 mg/silver mole of colloidal gold sulfide was added. The mixture was heated to 60° C., held at this temperature for 40 minutes, and then cooled to 40° C., at which point 90 mg/silver mole of 1-(3-acetamidophenyl)-5-mercaptotetrazole was added.

A control silver chloride cubic grain emulsion with an edge length of 0.75 μm was precipitated by equimolar addition of silver nitrate and sodium chloride solution into a well-stirred reactor containing bone gelatin peptizer and a thioether ripener, using procedures well known in the art and described in Section I of *Research Disclosure*, Item 308119, December 1989. This control emulsion was sensitized by adding 4 mg/mole of colloidal gold sulfide, heating to 60° C., and adding 200 mg/silver mole of blue-sensitizing dye SS-52, 70 mg/silver mole of 1-(3-acetamidophenyl)-5-mercaptotetrazole and 0.5 mole percent of potassium bromide.

The following elements, all containing 36 mg/ft$^2$ (390 mg/m$^2$) of silver from the just described blue-sensitized emulsions, and 70 mg/ft$^2$ (750 mg/m$^2$) of gelatin, were coated on a resin-coated paper support:

Control element 1: cubic grain AgCl emulsion 100 mg/ft$^2$ (1080 mg/m$^2$) of coupler C-25.

Element 2: tabular grain AgCl emulsion, 100 mg/ft$^2$ (1080 mg/m$^2$) of coupler C-25.

Control element 3: cubic grain AgCl emulsion 84 mg/ft$^2$ (900 mg/m$^2$) of coupler C-26.

Element 4: tabular grain AgCl emulsion, 84 mg/ft$^2$ (900 mg/m$^2$) of coupler C-26.

The elements were subjected to tungsten lamp exposures of equal energy at times of 0.5 and 0.01 second through a graduated density test object and then processed by Kodak TM Ektacolor RA-4 processing. Relative sensitivity values for each element were determined at a density of 1.0. The results are given in Table II.

TABLE II

| Element | Dmin | Dmax | Relative Log Sensitivity at 1.0 Density Exposure (seconds) 0.5 | 0.01 |
|---|---|---|---|---|
| 1 control | 0.09 | 2.73 | 100 | 88 |
| 2 invention | 0.09 | 2.92 | 113 | 114 |
| 3 control | 0.14 | 3.21 | 102 | 88 |
| 4 invention | 0.12 | 3.20 | 115 | 116 |

The data in Table II illustrate the higher sensitivity and superior reciprocity failure characteristics of elements containing a tabular grain silver chloride emulsion compared to those containing a cubic grain silver chloride emulsion.

Example 23—Light Emitting Diode (LED) Exposure and Processing of Recording Elements The elements prepared as described in Example 22 were exposed to a blue light emitting diode (LED) with a peak wavelength of 470 nm and a full width half maximum of 40 nm, using 0.004-inch (0.1 mm) pixels, a 1.0 neutral density filter, and an exposure time of microseconds/pixel. The exposed elements were processed by Kodak TM Ektacolor RA-4 processing, and relative sensitivities were determined at 1.0 density. The results are shown in Table III.

TABLE III

| Element | Dmin | Dmax | Relative Log Sensitivity at 1.0 Density, 100 microseconds/pixel Exposure |
|---|---|---|---|
| 1 control | 0.09 | 2.42 | 100 |
| 2 invention | 0.09 | 2.53 | 140 |
| 3 control | 0.14 | 2.55 | 94 |
| 4 invention | 0.12 | 2.55 | 129 |

The data in Table III illustrate the much higher sensitivities relative to the controls that were obtained with elements containing tabular grain blue-sensitized silver chloride emulsions when exposed, in accordance with the present invention, to a blue LED.

Example 24—Laser Exposure and Processing of Recording Elements

The elements prepared as described in Example 22 were exposed using a blue Argon Ion (multiline) apparatus at 476.5 nm at a resolution of 196.8 pixels/cm and a pixel pitch of 50.8 μm. The exposure time was 0.477 microsecond/pixel. After exposure, the elements were processed using Kodak TM Ektacolor RA-4 processing, and relative sensitivities were determined at densities of 1.0 and 1.5. The results are shown in Table IV.

TABLE IV

| Element | Dmin | Dmax | Relative Log Sensitivity 0.477 microsecond/pixel Exposure at Density 1.0 | 1.5 |
|---|---|---|---|---|
| 1 control | 0.09 | 2.25 | 100 | 100 |
| 2 invention | 0.09 | 2.45 | 135 | 132 |
| 3 control | 0.14 | 2.45 | 103 | 107 |
| 4 invention | 0.12 | 2.40 | 130 | 135 |

The data in Table IV demonstrate that elements containing a tabular grain blue-sensitized silver chloride emulsion exhibited substantially higher sensitivities than the control elements when subjected to laser exposure in accordance with the invention.

Example 25: Preparation, Laser Exposure, and Processing of Recording Elements

A portion of the tabular grain silver chloride emulsion T-1 of Example 2 was optimally blue-sensitized as follows: 580 mg/silver mole of sensitizing dye SS-52 was added to the emulsion after holding for 20 minutes, 1.4 mg/silver mole of colloidal gold sulfide was added. The mixture was heated to 60° C., held at this temperature for 40 minutes, and then cooled to 40° C., at which point 90 mg/silver mole of 1-(3-acetamidophenyl)-5-mercaptotetrazole was added. This emulsion was designated T-1A.

Another tabular grain silver chloride emulsion was precipitated as described in Example 2, except that 2.33 microgram of dicesium pentachloronitrosyl osmate was added during the precipitation.

The resulting emulsion contained 0.06 mole percent iodide, based on silver. More than 50 percent of the total grain projected area was provided by tabular grains having {100} major faces, with an average ECD of 1.42 μm and an average thickness of 0.146 μm. This emulsion was sensitized in an identical manner as described above, except that optimum amount of dye SS-52 was 700 mg/silver mole and optimum amount of colloidal gold sulfide was 2.4 mg/silver mole. This emulsion was designated T-1B.

A control silver chloride cubic grain emulsion with an edge length of 0.60 μm was prepared by the procedure described in Example 22, except that no thioether ripener was used. This emulsion was optimally blue sensitized by adding 300 mg/silver mole of sensitizing dye SS-52, 10 mg/silver mole of colloidal gold sulfide, heat digestion and final addition of 120 mg/silver mole of 1-(3-acetamidophenyl)-5-mercaptotetrazole. This emulsion was designated Control element 1.

Another control silver chloride cubic grain emulsion with an edge length of 0.60 μm was precipitated in the same way as described in Example 22, except that no thioether ripener and low methionine gelatin was used. This emulsion was optimally blue sensitized by adding 300 mg/silver mole of sensitizing dye SS-52, 0.4 mg/silver mole of colloidal gold sulfide, heat digestion and final addition of 120 mg/silver mole of 1-(3-acetamidophenyl)-5-mercaptotetrazole. This emulsion was designated Control element 2.

The following elements, all containing 26 mg/ft$^2$ (280 mg/m$^2$) of silver from just described emulsions, 100 mg/ft$^2$ (1080 mg/m$^2$) of coupler C-25, and 70 mg/ft$^2$ (750 mg/m$^2$) of gelatin were coated on a resin-coated paper support:

Control element 1: cubic grain AgCl emulsion, regular gelatin

Control element 2: cubic grain AgCl emulsion, low methionine gelatin

Element 3: tabular grain AgCl emulsion T-1A

Element 4: tabular grain AgCl emulsion T-1B

The elements prepared as described above were exposed using a blue Argon Ion TM multiline exposure apparatus at 476.5 nm at a resolution of 196.8 pixels/cm and a pixel pitch of 50.8 μm. The exposure time was 0.477 microsecond/pixel. After exposure, the elements were processed using Kodak TM Ektacolor RA-4 processing, and relative sensitivities were determined at densities of 0.5, 1.0, and 1.5. The results are shown in Table V.

TABLE V

| Element | Dmin | Dmax | Relative Log Sensitivity 0.477 microsecond/pixel Exposure at Density 0.5 | 1.0 | 1.5 |
|---|---|---|---|---|---|
| 1 control | 0.06 | 2.20 | 100 | 100 | 100 |
| 2 control | 0.06 | 2.20 | 135 | 133 | 136 |
| 3 invention | 0.08 | 2.10 | 162 | 158 | 155 |
| 4 invention | 0.06 | 2.20 | 145 | 150 | 155 |

The data in Table V illustrate the much higher sensitivity in laser exposure of elements containing emulsions T1-A and T1-B compared to controls containing a cubic grain silver chloride emulsions prepared with the use of different gelatin peptizers.

Example 26: Preparation, Exposure, and Processing of Recording Elements

A portion of the tabular grain silver chloride emulsion T-19 of Example 20 was optimally blue-sensitized as follows: 580 mg/silver mole of sensitizing dye SS-52 was added to the emulsion. After holding for 20 minutes, 3 mg/silver mole of colloidal gold sulfide was added. The mixture was heated to 60° C., held at this temperature for 40 minutes, and then cooled to 40° C., at which point 100 mg/silver mole of 1-(3-acetamidophenyl)-5-mercaptotetrazole was added. This emulsion was designated T-19S.

A portion of the tabular grain silver chloride emulsion T-20 of Example 21 was optimally blue-sensitized as follows: 640 mg/silver mole of sensitizing dye SS-52 was added to the emulsion. After holding for 20 minutes, 1.5 mg/silver mole of colloidal gold sulfide was added. The mixture was heated to 60° C., held at this temperature for 40 minutes, and then cooled to 40° C., at which point 90 mg/silver mole of 1-(3-acetamidophenyl)-5-mercaptotetrazole was added. This emulsion was designated T-20S.

A control silver chloride cubic grain emulsion with an edge length of 0.75 μm was precipitated by equimolar addition of silver nitrate and sodium chloride solution into a well-stirred reactor containing bone gelatin peptizer and a thioether ripener, using procedures well known in the art and described in Section I of *Research Disclosure*, Item 308119, December 1989. This control emulsion was sensitized by adding 4 mg/mole of colloidal gold sulfide, heating to 60° C., and adding 200 mg/silver mole of blue-sensitizing dye SS-52, 70 mg/silver mole of 1-(3-acetamidophenyl)-5-mercaptotetrazole and 0.5 mole percent of potassium bromide.

The following elements, all containing 26 mg/ft$^2$ (280 mg/m$^2$) of silver from just described emulsions, 100 mg/ft$^2$ (1080 mg/m$^2$) of coupler C-25, and 70 mg/ft$^2$ (750 mg/m$^2$) of gelatin were coated on a resin-coated paper support:

Control element 1: cubic grain AgCl emulsion
Element 2: tabular grain AgCl emulsion T-19S
Element 3: tabular grain AgCl emulsion T-20S The three elements were subjected to blue light exposures of equal energy at times of 0.1 second and 10 microseconds through a graduated test object and then processed by Kodak TM Ektacolor RA-4 processing. Relative sensitivity values were determined at 0.95 above Dmin. The results are shown in Table VI.

TABLE VI

| | | | | Relative Log Sensitivity at Dmin + 0.95 Exposure | |
|---|---|---|---|---|---|
| Element | Emulsion | Dmin | Dmax | 0.1 second | 10 microseconds |
| 1 | Control | 0.07 | 2.30 | 100 | 68 |
| 2 | Invention | 0.10 | 2.25 | 118 | 105 |
| 3 | Invention | 0.11 | 2.20 | 130 | 131 |

As is readily apparent from the data in Table VI, both tabular grain emulsions exhibited unexpectedly better high intensity reciprocity failure characteristics and much higher sensitivity at short exposure time than the control element.

Example 27: Preparation, Exposure, and Processing of Recording Elements

A portion of the tabular grain silver chloride emulsion T-3 of Example 4 was blue-sensitized as follows: 580 mg/silver mole of sensitizing dye SS-52 were added to the emulsion. After holding for 20 minutes, 0.15 mg/silver mole of colloidal gold sulfide was added to the emulsion followed by the addition of 800 mg/silver mole of sensitizing dye SS-52, 90 mg/silver mole of 1-(3-acetamidophenyl)-5-mercaptotetrazole, and 100 mg/silver mole of 4-hydroxy-6-methyl-1,3,3a,7-tetraazaindene.

A control silver chloride cubic emulsion with an edge length of 0.75 μm was precipitated by equimolar addition of silver nitrate and sodium chloride solution into a well-stirred reactor containing bone gelatin peptizer and a thioether ripener, using procedures well known in the art and described in Section I of *Research Disclosure*, Item 308119, cited above. This control emulsion was sensitized by adding 4 mg/mole of colloidal gold sulfide, heating to 60° C., and adding 200 mg/silver mole of blue-sensitizing dye SS-52, 70 mg/silver mole of 1-(3-acetamidophenyl)-5-mercaptotetrazole and 0.5 mole percent of potassium bromide.

The following elements, all containing 100 mg/ft$^2$ (1080 mg/m$^2$) of silver from the above identified emulsions and including 100 mg/ft$^2$ (1080 mg/m$^2$) of gelatin were coated on a resin-coated paper support which was pre-coated with a layer containing 70 mg/ft$^2$ (753 mg/m$^2$) of 2-napthalenecarboxamide, 4-{[(4-[4-{[5-chloro-2-(methylsulfonyl)phenyl]azo}-3-cyano-4,5-dihydro-5-oxo-1H-pyrazol-1-yl]phenyl)sulfonyl-]amino}-1-hydroxy-N,N-dioctadecane, 3.1 mg/ft$^2$ (33.4 mg/m$^2$) 2,5-dihydroxy-4-(1-methylheptadecyl)-benzenesulfonic acid, and 110 mg/ft$^2$ (1180 mg/m$^2$) gelatin. Finally, an overcoat layer was coated on top of the above coatings. It contained 80 mg/ft$^2$ (860 mg/m$^2$) of carbanic acid, methyl-[{[(4-methylphenyl)sulfonyl-]amino}-2-{[methyl(trifluoroacetyl)amino]methyl}phenyl]-4,5-dihydro-1-phenyl-1H-pyrazol-3-yl ester, 30 mg/ft$^2$ (323 mg/m$^2$) of N,N'-(4-hydroxy-1,3-phenylene)bis[4-(dodecyloxy)]benzenesulfonamine and 150 mg/ft$^2$ (1614 mg/m$^2$) gelatin.

These elements were given blue LED exposure, as described in Example 23.

After exposure these coatings were immersed for 20 second in a solution containing 0.6M KOH, 3 g/L 5-methylbenzotriazole, 2 g/L KBr, and 8 g/L $K_2SO_3$, which was followed by a lamination onto a receiver sheet. The receiver sheet contained 100 mg/ft$^2$ (1080 mg/m$^2$) of quaternized copolymer made up of vinylbenzyl chloride and ethylene glycol (93:7) and 100 mg/ft$^2$ (1080 mg/m$^2$) gelatin coated on resin-coated paper support. Upon diffusion of imagewise produced dyes from the donor to receiver sheets, the donor and receiver sheets were separated, and the relative LED sensitivity of an image on receiver sheet was determined at a density of 1.0. Table VII contains the results.

TABLE VII

| Element | Emulsion | Dmin | Dmax | Relative Log Sensitivity at 1.0 Density, 100 microseconds/pixel Exposure |
|---|---|---|---|---|
| 1 | Control cubic grain AgCl | 0.16 | 2.10 | 100 |
| 2 | Tabular grain AgCl | 0.19 | 2.10 | 146 |

The data in Table VII demonstrates a much higher sensitivity for the tabular grain emulsion as compared to that of cubic grain control emulsion.

Example 28—Preparation, Exposure, and Processing of Multicolor Recording Elements The tabular grain silver chloride emulsion T-2 of Example 3 was blue-sensitized by the procedure used with emulsion T-1 in Example 22, except that 1 mole percent of potassium bromide was added following the addition of gold sulfide.

A control silver chloride cubic grain emulsion with an edge length of 0.6 μm was prepared and blue-sensitized by the procedures described in Example 22; this was designated control emulsion A. The sensitized silver chloride cubic grain emulsion with an edge length of 0.74 μm used in Example 20 was designated control emulsion B.

The three emulsions were mixed with a dispersion of coupler C-25 and coated as the bottom layers in multicolor elements on resin-coated paper. The elements contained the following layers, starting from the top: gelatin overcoat, red-sensitive layer containing silver chloride cubic grain emulsion and cyan coupler, gelatin interlayer, green-sensitive layer containing silver chloride cubic grain emulsion and magenta coupler, interlayer containing 105 mg/ft$^2$ (1130 mg/m$^2$) of gelatin, blue-sensitive layer containing tabular grain silver chloride emulsion or control emulsions and yellow coupler. Each of the blue-sensitive layers contained 26 mg/ft$^2$ (280 mg/m$^2$) of silver, 100 mg/ft$^2$ (1080 mg/m$^2$) of coupler C-25, and 74 mg/ft$^2$ (800 mg/m$^2$) of gelatin.

The three elements were subjected to blue light exposures of equal energy at times of 0.1 second and 10 microseconds (μ-sec) through a graduated test object and then processed by Kodak TM Ektacolor RA-4 processing. Relative sensitivity values were determined at a density of 0.35 above Dmin. The results are shown in Table VIII.

TABLE VIII

| Element | Emulsion | Dmin | Dmax | Relative Log Sensitivity 0.1 sec | Relative Log Sensitivity 10 μ-sec |
|---|---|---|---|---|---|
| 1 | Control A | 0.098 | 2.10 | 119 | 77 |
| 2 | Control B | 0.084 | 2.08 | 100 | 53 |
| 3 | Tabular grain AgCl | 0.113 | 2.08 | 110 | 119 |

As is readily apparent from the data in Table VIII, Element 3, which contained a silver chloride {100} tabular grain emulsion in its layer nearest the support, exhibited both superior sensitivity and a more invariant level of sensitivity as a function of varied exposures than the control elements.

Example 29—LED Exposure and Processing of Multicolor Recording Elements

The elements prepared as described in Example 28 were exposed to a blue LED, as described in Example 23. After Kodak TM Ektacolor RA-4 processing, the relative LED sensitivity of each element was determined at a density of 1.0. Table IX contains the results.

TABLE IX

| Element | Emulsion | Dmin | Dmax | Relative Log Sensitivity 100 microseconds/pixel Exposure |
|---|---|---|---|---|
| 1 | Control A | 0.098<br>0.08 | 2.06 | 114 |
| 2 | Control B | 0.08 | 1.94 | 100 |
| 3 | Tabular grain AgCl | 0.0113 | 2.06 | 126 |

The data in Table IX demonstrate that, as was previously observed with single layer elements in Example 23, multilayer multicolor elements containing a silver chloride {100} tabular grain emulsion in the lowermost layer exhibited substantially higher sensitivity than the control elements containing a cubic grain silver halide emulsion in that layer.

Example 30—Preparation, LED Exposure, and Processing of Multicolor Recording Elements The tabular grain silver chloride emulsion T-1 of Example 2 was blue-sensitized as follows: 440 mg/silver mole of sensitizing dye SS-56 were added to the emulsion. After holding for 20 minutes, 1.4 mg/silver mole of colloidal gold sulfide were added. The mixture was heated to 60° C., held at this temperature for 40 minutes, and then cooled to 40° C., at which point 90 mg/silver mole of 1-(3-acetamidophenyl)-5-mercaptotetrazole were added.

A control silver chloride cubic grain emulsion with an edge length of 0.75 μm was precipitated by equimolar addition of silver nitrate and sodium chloride solution into a well-stirred reactor containing bone gelatin peptizer and a thioether ripener, using procedures well known in the art and described in Section I of *Research Disclosure*, Item 308119, cited above. This control emulsion was sensitized by adding 4 mg/mole of colloidal gold sulfide, heating to 60 ° C., and adding 256 mg/silver mole of blue-sensitizing dye SS-56, 70 mg/silver mole of 1-(3-acetamidophenyl)-5-mercaptotetrazole and 0.5 mole percent of potassium bromide.

The following elements, all containing 26 mg/ft$^2$ (280 mg/m$^2$) of silver from the just described blue-sensitized emulsions, and 70 mg/ft$^2$ (750 mg/m$^2$) of gelatin, were mixed with a dispersion of coupler C-25 and coated on a resin-coated paper support as a bottom layer of a multilayer pack. The multilayer format was identical with that described in Example 27. The emulsions were designated as follows:

Control element 1: cubic grain AgCl emulsion, 100 mg/ft$^2$ (1080 mg/m$^2$) of coupler C-25.

Element 2: tabular grain AgCl emulsion, 100 mg/ft$^2$ (1080 mg/m$^2$) of coupler C-25.

Another part of the tabular grain silver chloride emulsion T-1 of Example 2 was blue-sensitized as follows: 460 mg/silver mole of sensitizing dye SS-57 were added to the emulsion. After holding for 20 minutes, 1.4 mg/silver mole of colloidal gold sulfide were added. The mixture was heated to 60 ° C., held at this temperature for 40 minutes, and then cooled to 40° C., at which point 90 mg/silver mole of 1-(3-acetamidophenyl)-5-mercaptotetrazole were added.

Another part of the control silver chloride cubic grain emulsion with an edge length of 0.75 μm was sensitized by adding 4 mg/mole of colloidal gold sulfide, heating to 60° C., and adding 222 mg/silver mole of blue-sensitizing dye SS-57, 70 mg/silver mole of 1-(3-acetamidophenyl)-5-mercaptotetrazole and 0.5 mole percent of potassium bromide.

The following elements were coated as described above and designated as follows:

Control element 3: cubic grain AgCl emulsion, 100 mg/ft$^2$ (1080 mg/m$^2$) of coupler C-25.

Element 4: tabular grain AgCl emulsion, 100 mg/ft$^2$ (1080 mg/m$^2$) of coupler C-25.

The elements were subjected a blue LED exposure, as described in Example 23. After Kodak TM Ektacolor RA-4 processing, the relative LED sensitivity of each element was determined at a density of 1.0. Table X contains the results.

TABLE X

| Element | Dmin | Dmax | Relative Log Sensitivity 100 microseconds/pixel Exposure |
|---|---|---|---|
| 1 control | 0.094 | 1.65 | 100 |
| 2 invention | 0.119 | 2.10 | 136 |
| 3 control | 0.085 | 2.00 | 112 |
| 4 invention | 0.103 | 2.00 | 138 |

The data in Table X demonstrates that a multilayer multicolor elements containing a tabular grain silver chloride emulsion sensitized with alternative blue sensitizing dyes in the lowermost layer exhibited substantially higher sensitivity than the control elements containing a cubic grain silver halide emulsion in that layer.

Example 31—Preparation, Exposure, and Processing of Recording Elements

A portion of the silver chloride {100} tabular grain emulsion T-3 of Example 4 was green-sensitized as follows: 350 mg/silver mole of sensitizing dye SS-53 were added to the emulsion. After holding for 20 minutes, 0.25 mg/silver mole of colloidal gold sulfide was added. The mixture was heated to 60° C., held at this temperature for 40 minutes, and then cooled to 40° C. Then 100 mg/silver mole of 1-(3-acetamido-phenyl)-5-mercaptotetrazole was added, followed after 10 minutes by the addition of 0.5 mole percent of potassium bromide. This emulsion was designated T-3A.

A second portion of emulsion T-3 was sensitized as first described, except that the amount of dye SS-53 was increased 14 percent and the amount of gold sulfide was quadrupled. This emulsion was designated T-3B.

A control silver chloride cubic grain emulsion with an edge length of 0.42 μm was prepared by the procedure described in Example 22, except that low (<30 micromole/gram) methionine gelatin peptizer was used. This emulsion was green-sensitized by adding 300 mg/Ag mole of sensitizing dye SS-53 and 0.5 mg/Ag mole of colloidal gold sulfide, heating to 60° C., and adding 100 mg/Ag mole of 1-(3-acetamidophenyl)-5-mercaptotetrazole and 0.5 mole percent of potassium bromide.

The following elements, all containing 26 mg/ft$^2$ (280 mg/m$^2$) of silver from the just described emulsions, 39.3 mg/ft$^2$ (420 mg/m$^2$) of coupler C-20, and 70 mg/ft$^2$ (750 mg/m$^2$) of gelatin were coated on a resin-coated paper support:

Control element 1: cubic grain AgCl emulsion
Element 2: tabular grain AgCl emulsion T-3A
Element 3: tabular grain AgCl emulsion T-3B The elements were given tungsten lamp exposures of equal energy at times of 0.1 second and 10 microseconds through a graduated density test object, then processed by Kodak TM Ektacolor RA-4 processing. Relative sensitivities were determined at a density of 0.35 above Dmin. The results are shown in Table XI.

TABLE XI

| Element | Dmin | Dmax | Relative Log Sensitivity 0.1 sec | Relative Log Sensitivity 10 μ-sec |
|---|---|---|---|---|
| 1 control | 0.19 | 2.96 | 100 | 77 |
| 2 invention | 0.14 | 2.48 | 141 | 134 |
| 3 invention | 0.17 | 2.61 | 148 | 129 |

The data in Table XI illustrate the much higher sensitivity and substantially improved high intensity reciprocity failure characteristics of elements containing tabular grain silver chloride emulsions compared to a control containing a cubic grain silver chloride emulsion.

Example 32—LED Exposure and Processing of Recording Elements

The elements prepared as described in Example 31 were exposed to a green light emitting diode (LED) with a peak wavelength of 565 nm and a full width half maximum of 30 nm, using 0.004-inch (0.1 mm) pixels, a 0.7 neutral density filter, and an exposure time of 100 microseconds/pixel. The exposed elements were processed by Kodak TM Ektacolor RA-4 processing, and relative sensitivities were determined at 1.0 density. The results are given in Table XII.

TABLE XII

| Element | Dmin | Dmax | Relative Log Sensitivity 100 microseconds/pixel Exposure |
|---|---|---|---|
| 1 control | 0.19 | 2.51 | 100 |
| 2 invention | 0.14 | 2.35 | 126 |
| 3 invention | 0.17 | 2.39 | 128 |

The data in Table XII illustrate the substantially higher sensitivities relative to the control that were obtained with elements containing green-sensitized silver chloride {100} tabular grain emulsions when exposed, in accordance with the present invention, to a green LED.

Example 33—Laser Exposure and Processing of Recording Elements

The elements prepared as described in Example 31 were subjected to laser exposure using a green Argon Ion TM multiline exposure apparatus at 514.5 nm, a resolution of 196.8 pixels/cm, and a pixel pitch of 50.8 μm. The exposure time was 0.477 μsecond/pixel. After Kodak TM Ektacolor RA-4 processing, relative laser sensitivities were determined at densities of 1.0 and 1.5. Table XIII contains the results of these measurements.

TABLE XIII

| Element | Dmin | Dmax | Relative Log Sensitivity 0.477 microsecond/pixel Exposure at Density 1.0 | Relative Log Sensitivity 0.477 microsecond/pixel Exposure at Density 1.5 |
|---|---|---|---|---|
| 1 control | 0.19 | 2.50 | 100 | 100 |
| 2 invention | 0.14 | 2.30 | 141 | 138 |
| 3 invention | 0.17 | 2.45 | 144 | 142 |

The data in Table XIII demonstrate that elements containing a tabular grain green-sensitized silver chloride emulsion exhibited much higher sensitivities than the control element when subjected to laser exposure in accordance with the invention.

Example 34—Preparation, Exposure, and Processing of Recording Elements

A portion of the tabular grain silver chloride emulsion T-4 of Example 5 was red-sensitized as follows: 1 mg/silver mole of colloidal gold sulfide was added to the emulsion. After heating for 30 minutes at 60° C., the emulsion was cooled to 40° C., and 200 mg/silver mole of 1-(3-acetamidophenyl)-5-mercaptotetrazole was added. After 10 minutes, 1 mole percent of potassium bromide was added, and after 15 minutes more, 20.8 mg/silver mole of sensitizing dye SS-54 was added. After another 15 minutes holding, the mixture was chill set. This emulsion was designated T-4A.

Another portion of emulsion T-4 was red-sensitized by the same procedure used for T-4A, except that 100 mg/silver mole of the supersensitizing compound SU-1 was first added to the emulsion. The resulting sensitized emulsion was designated T-4B.

A third portion of emulsion T-4 was red-sensitized by the same procedure used for T-4B, except that the sensitizing dye SS-55 was used instead of SS-54. The resulting emulsion was designated T-4C.

A control silver chloride cubic emulsion with an edge length of 0.40 μm was prepared by the procedure described in Example 22. The emulsion was red-sensitized by adding 20 mg/Ag mole of colloidal gold sulfide, heating, then adding 300 mg/Ag mole of 1-(3-acetamidophenyl)-5-mercaptotetrazole, 1 mole percent of potassium bromide, and 15 mg/Ag mole of red-sensitizing dye SS-54.

The following elements, all containing 17 mg/ft$^2$ (180 mg/m$^2$) of silver from the just described emulsions, 39.3 mg/ft$^2$ (420 mg/m$^2$) of coupler C-5, and 70 mg/ft$^2$ (750 mg/m²) of gelatin were coated on a resin-coated paper support:

Control element 1: cubic grain AgCl emulsion
Element 2: tabular grain AgCl emulsion T-4A
Element 3: tabular grain AgCl emulsion T-4B
Element 4: tabular grain AgCl emulsion T-4C The elements were subjected to tungsten lamp exposures of equal energy at times of 0.1 second and 10 microseconds through a graduated test object, then processed by Kodak TM Ektacolor RA-4 processing. Relative sensitivity values were determined at a density of 0.35 above Dmin. The results are presented in Table XIV.

TABLE XIV

| Element | Dmin | Dmax | Relative Log Sensitivity 0.1 sec | Relative Log Sensitivity 10 μ-sec |
|---|---|---|---|---|
| 1 control | 0.11 | 2.59 | 100 | 88 |
| 2 invention | 0.20 | 2.54 | 140 | 135 |
| 3 invention | 0.15 | 2.53 | 143 | 143 |
| 4 invention | 0.16 | 2.46 | 146 | 145 |

The results in Table XIV demonstrate the much greater sensitivity and the excellent reciprocity failure characteristics of elements containing tabular grain silver chloride emulsions compared to a control containing a cubic grain silver chloride emulsion.

Example 35—LED Exposure and Processing of Recording Elements

The elements prepared as described in Example 34 were exposed to a red light emitting diode (LED) with a peak wavelength of 660 nm and a full width half maximum of 25 nm, using 0.004-inch (0.1 mm) pixels, a 1.0 neutral density filter, and an exposure time of 100 microseconds/pixel. The exposed elements were given Kodak TM Ektacolor RA-4 processing, and relative sensitivities were determined at densities of 1.0 and 1.5. The results are shown in Table XV.

TABLE XV

| Element | Dmin | Dmax | Relative Log Sensitivity 100 microseconds/pixel Exposure at Density 1.0 | Relative Log Sensitivity 100 microseconds/pixel Exposure at Density 1.5 |
|---|---|---|---|---|
| 1 control | 0.11 | 2.54 | 100 | 100 |
| 2 invention | 0.20 | 2.36 | 145 | 155 |
| 3 invention | 0.15 | 2.43 | 146 | 161 |
| 4 invention | 0.16 | 2.33 | 163 | 174 |

The data in Table XV demonstrate the much higher sensitivities relative to the control that were obtained with elements containing tabular red-sensitized silver chloride emulsions when exposed, in accordance with the invention, to a red LED.

Example 36—Laser Exposure and Processing of Recording Elements

The elements prepared as described in Example 34 were subjected to laser exposure using a red Toshiba TOLD 9140 TM exposure apparatus at 685 nm, a resolution of 176.8 pixels/cm, a pixel pitch of 50.8 μm, and an exposure time of 0.05 microsecond/pixel. The elements were processed using Kodak TM Ektacolor RA-4 processing, and relative sensitivities were determined at densities of 1.0 and 1.5. Table XVI summarizes the results.

TABLE XVI

| Element | Dmin | Dmax | Relative Log Sensitivity 0.05 microsecond/pixel Exposure at Density 1.0 | Relative Log Sensitivity 0.05 microsecond/pixel Exposure at Density 1.5 |
|---|---|---|---|---|
| 1 control | 0.11 | 2.54 | 100 | 100 |
| 2 invention | 0.20 | 2.36 | 183 | 230 |
| 3 invention | 0.15 | 2.43 | 183 | 226 |
| 4 invention | 0.16 | 2.33 | 176 | 218 |

The data in Table XVI show that elements containing tabular grain red-sensitized silver chloride emulsions exhibited very much higher sensitivities than the control element when subjected to laser exposure in accordance with the invention.

Example 37—Preparation, Exposure, and Processing of Recording Elements

A portion of the tabular grain silver chloride emulsion T-4 of Example 5 was red-sensitized as follows: 200 mg/silver mole of the supersensitizing compound SU-1 were added to the emulsion, followed after 10 minutes by 10 mg/silver mole of colloidal gold sulfide. The mixture was heated for 30 minutes at 60 C; then 200 mg/silver mole of 1-(3-acetamidophenyl)-5-mercaptotetrazole were added, followed 10 minutes later by 1 mole percent of potassium bromide. After 10 minutes more, 20.8 mg/silver mole of sensitizing dye SS-54 were added. After another 15 minutes holding, the mixture was chill set. This emulsion was designated T-4D.

Another portion of emulsion T-4 was red-sensitized by the following procedure: 42 mg/silver mole of sensitizing dye SS-54 were added to the emulsion, followed 15 minutes later by 100 mg/silver mole of compound SU-1. The resulting mixture was held for 15 minutes; then 2 mole percent of a Lippmann silver bromide emulsion were added, and the mixture was heated for 15 minutes at 65° C. The mixture was cooled to 40° C., and 4 mg/silver mole of sodium thiosulfate were added, followed 5 minutes later by 100 mg/silver mole of tetraazaindene. After 5 minutes holding, the mixture was heated at 65° C. for 20 minutes, then cooled to 40° C. Finally, 120 mg/silver mole of 1-(3-acetamidophenyl)-5-mercaptotetrazole was added, and after 10 minutes the emulsion was chill set. This emulsion was designated T-4E.

A third portion of emulsion T-4 was red-sensitized by the same procedure used to prepare T-4E, but the amount of sensitizing dye SS-54 was increased by 70 percent. The resulting emulsion was designated T-4F.

The following elements, all containing 17 mg/ft² (180 mg/m²) of silver from the just described emulsions, 39.3 mg/ft² (420 mg/m²) of coupler C-5, and 70 mg/ft² (750 mg/m²) of gelatin were coated on a resin-coated paper support:

Element 2: tabular grain AgCl emulsion T-4D
Element 3: tabular grain AgCl emulsion T-4E
Element 4: tabular grain AgCl emulsion T-4F The elements 2, 3 and 4 and the control element of Example 34 were subjected to laser exposure as described in Example 36. After Kodak TM Ektacolor RA-4 processing, the relative sensitivities of the elements were determined at densities of 1.0 and 1.5. The results are summarized in Table XVIII.

TABLE XVII

| Element | Dmin | Dmax | Relative Log Sensitivity 0.05 microsecond/pixel Exposure at Density 1.0 | 1.5 |
|---|---|---|---|---|
| 1 control | 0.11 | 2.46 | 100 | 100 |
| 2 invention | 0.11 | 2.36 | 195 | 226 |
| 3 invention | 0.11 | 2.38 | 174 | 187 |
| 4 invention | 0.11 | 2.35 | 188 | 187 |

The data in Table XVIII show that elements containing red-sensitized silver chloride {100} tabular grain emulsions exhibited much higher sensitivities than the control element when subjected to laser exposure in accordance with the present invention.

The invention has been described in detail with particular reference to preferred embodiments thereof, but it will be understood that variations and modifications can be effected within the spirit and scope of the invention.

What is claimed is:

1. An electronic printing method which comprises subjecting a radiation sensitive silver halide emulsion layer of a recording element to actinic radiation of at least $10^{-4}$ erg/cm$^2$ for up to 100 microseconds duration in a pixel-by-pixel mode, characterized in that the silver halide emulsion layer contains a silver halide grain population comprising at least 50 mole percent chloride, based on silver, wherein at least 50 percent of the grain population projected area is accounted for by tabular grains (a) bounded by {100} major faces having adjacent edge ratios of less than 10, and (b) each having an aspect ratio of at least 2.

2. A method according to claim 1 wherein the aspect ratio is at least 5.

3. A method according to claim 1 wherein the aspect ratio is greater than 8.

4. A method according to claim 1 wherein the edge ratios are less than 5.

5. A method according to claim 1 wherein the edge ratios are less than 2.

6. A method according to claim 1 wherein the tabular grains have thicknesses of less than 0.3 μm.

7. A method according to claim 1 wherein the tabular grains have thicknesses of less than 0.2 μm.

8. A method according to claim 1 wherein the tabular grains internally contain iodide at their nucleation sites and have an average thickness of less than 0.06 μm.

9. A method according to claim 1 wherein the tabular grains contain at least 70 mole percent chloride.

10. A method according to claim 9 wherein the tabular grains are silver iodochloride grains.

11. A method according to claim 9 wherein the tabular grains are silver bromochloride or silver chloride grains.

12. A method according to claim 1 wherein the tabular grains contain at least 90 mole percent chloride and internally contain iodide at their nucleation sites.

13. A method according to claim 1 wherein the recording element is a monochrome recording element.

14. A method according to claim 13 wherein the silver halide emulsion layer is blue-sensitized, green-sensitized or red-sensitized.

15. A method according to claim 1 wherein the recording element is a multicolor, multilayer element comprising a red-sensitized silver halide emulsion layer, a green-sensitized silver halide emulsion layer and a blue-sensitized silver halide emulsion layer, and at least one of these emulsions layers contains the tabular grains bounded by {100} major faces.

16. A method according to claim 15 wherein one of the silver halide emulsion layers that contains tabular silver halide grains bounded by {100} major faces is blue-sensitized.

17. A method according to claim 1 wherein the pixels are exposed to actinic radiation of about $10^{-4}$ erg/cm$^2$ to $10^3$ ergs/cm$^2$.

18. A method according to claim 1 wherein the pixels are exposed to actinic radiation of about $10^{-3}$ erg/cm$^2$ to $10^2$ ergs/cm$^2$.

19. A method according to claim 1 wherein the exposure is up to 10 microseconds.

20. A method according to claim 19 wherein the exposure is up to 0.5 microsecond.

21. A method according to claim 17 wherein the duration of the exposure is at least 0.01 microsecond.

22. A method according to claim 1 wherein the source of actinic radiation is a light emitting diode.

23. A method according to claim 1 wherein the source of actinic radiation is a laser.

24. A method according to claim 15 wherein the actinic radiation comprises a combination of red, green and blue wavelengths to which the recording element is sensitive.

25. A method according to claim 23 wherein the recording element is exposed to a portion of the infrared region of the spectrum by a laser source to produce at least one cyan, magenta or yellow dye.

26. A method according to claim 1 wherein the recording element contains a sulfonamidoaniline or sulfonamidophenol dye image providing compound.

27. A method according to claim 26 wherein the recording element contains an image dye providing compound of the formula:

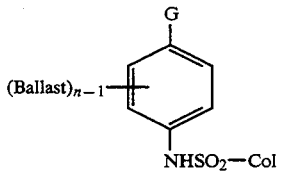

wherein

Col is a dye or dye precursor moiety;

Ballast is an organic ballasting radical of such molecular size and configuration as to render the formula compound nondifussible during development in an alkaline processing solution having a pH in excess of 11;

G is OR or NHR$_1$ wherein R is hydrogen or a hydrolyzable moiety and R$_1$ is hydrogen or an alkyl group of from 1 to 22 carbon atoms; and n is a positive integer of 1 to 2 and is 2 when G is OR or when R$_1$ is hydrogen or an alkyl group of less than 8 carbon atoms.

* * * * *